US011911707B2

(12) United States Patent
Henry et al.

(10) Patent No.: US 11,911,707 B2
(45) Date of Patent: Feb. 27, 2024

(54) ROTATABLE PLAY DEVICE

(71) Applicant: PlayCore Wisconsin, Inc., Chattanooga, TN (US)

(72) Inventors: Brian Henry, Fort Payne, AL (US); Kim Blackwood, Boaz, AL (US); Emily Mauermann, Chattanooga, TN (US); Thomas Norquist, Fort Payne, AL (US)

(73) Assignee: PLAYCORE WISCONSIN, INC., Chattanooga, TN (US)

( * ) Notice: Subject to any disclaimer, the term of this patent is extended or adjusted under 35 U.S.C. 154(b) by 0 days.

(21) Appl. No.: 17/844,501

(22) Filed: Jun. 20, 2022

(65) Prior Publication Data

US 2022/0314131 A1 Oct. 6, 2022

Related U.S. Application Data

(63) Continuation of application No. 17/116,162, filed on Dec. 9, 2020, now Pat. No. 11,364,445, which is a continuation of application No. 16/580,473, filed on Sep. 24, 2019, now Pat. No. 10,881,971, which is a continuation-in-part of application No. 16/512,575, filed on Jul. 16, 2019, now Pat. No. 10,835,831, said application No. 16/512,575 is a continuation of application No. 15/877,015, filed on Jan. 22, 2018, (Continued)

(51) Int. Cl.

| | |
|---|---|
| ***A63G 1/28*** | (2006.01) |
| ***A63G 9/12*** | (2006.01) |
| ***A63G 1/14*** | (2006.01) |

(52) U.S. Cl.

CPC ..... *A63G 1/28* (2013.01); *A63G 1/14* (2013.01); *A63G 9/12* (2013.01)

(58) Field of Classification Search

CPC ... A63G 9/00; A63G 9/12; A63G 9/16; A63G 9/20; A47D 13/00; A47D 13/043; A47D 13/046

USPC ..... 472/118–125

See application file for complete search history.

(56) References Cited

U.S. PATENT DOCUMENTS

| | | | |
|---|---|---|---|
| 519,178 | A | 5/1894 | Douglas et al. |
| 1,142,970 | A | 6/1915 | Koehler |

(Continued)

*Primary Examiner* — Kien T Nguyen

(74) *Attorney, Agent, or Firm* — McAndrews, Held & Malloy, Ltd.

(57) ABSTRACT

Embodiments of the present disclosure are directed to a rotatable play device that comprises a central support post, a hub rotatably mounted to an upper end of the central support post, and an arm assembly attached to the hub and comprising a plurality of arms, a seat being suspended from the distal end of each of the plurality of arms. Rotation of the hub about the central support post causes the plurality of seats to rotate around the central support post in a substantially circular rotation path. Each of the seats may also be configured to move up and down by way of a spring assembly or a plurality of springs. Two or more seats may share the up-and-down movement in an alternating manner or each seat may be configured to have an independent up-and-down movement. In addition, each of the seats may optionally be configured to swing in substantial alignment with the circular rotation path and/or to swing outward due to centripetal forces created by the circular rotation path.

16 Claims, 25 Drawing Sheets

Related U.S. Application Data now Pat. No. 10,391,409, which is a continuation of application No. 15/363,820, filed on Nov. 29, 2016, now Pat. No. 9,873,057.

(60) Provisional application No. 62/735,673, filed on Sep. 24, 2018, provisional application No. 62/406,791, filed on Oct. 11, 2016.

(56) References Cited

U.S. PATENT DOCUMENTS

| | | | | |
|---|---|---|---|---|
| 2,765,168 | A | 10/1956 | Taylor | |
| 2,925,272 | A | 2/1960 | Hannas | |
| 3,090,617 | A | 5/1963 | Hjelte et al. | |
| 3,397,881 | A | 8/1968 | Hedgecock | |
| 3,599,973 | A * | 8/1971 | Ahrens | A63G 9/00 472/4 |
| 3,730,587 | A | 5/1973 | Bloxham et al. | |
| 4,431,183 | A * | 2/1984 | Reimann | A63G 9/00 472/118 |
| 4,978,120 | A | 12/1990 | Greenwood | |
| 5,833,545 | A | 11/1998 | Pinch et al. | |
| 5,947,875 | A | 9/1999 | Cone et al. | |
| 8,033,922 | B1 | 10/2011 | Marquez | |
| 8,313,388 | B2 | 11/2012 | Ochi | |
| 8,475,342 | B2 | 7/2013 | Flowers et al. | |
| 8,715,095 | B2 | 5/2014 | Hsieh | |
| 9,440,154 | B1 * | 9/2016 | Cordray | A63G 9/12 |
| 2012/0178543 | A1 | 7/2012 | Monachello | |

* cited by examiner

ROTATABLE PLAY DEVICE

This application is a continuation of U.S. patent application Ser. No. 17/116,162, filed on Dec. 9, 2020, which is a continuation of U.S. patent application Ser. No. 16/580,473, filed on Sep. 24, 2019, which is a continuation-in-part of U.S. patent application Ser. No. 16/512,575, filed on Jul. 16, 2019, which is a continuation of U.S. patent application Ser. No. 15/877,015, filed on Jan. 22, 2018, which is a continuation of U.S. patent application Ser. No. 15/363,820, filed on Nov. 29, 2016, which claims priority to U.S. Provisional Patent Application No. 62/406,791, filed on Oct. 11, 2016, the entireties of all of which are incorporated by reference herein. As a continuation of U.S. patent application Ser. No. 16/580,473, this application also claims priority to U.S. Provisional Patent Application No. 62/735,673, filed on Sep. 24, 2018, the entirety of which is also incorporated by reference herein.

BACKGROUND OF THE INVENTION

Swings are an integral part of the playground experience. Yet swings are conventionally aligned either next to one another in a row so that children may all swing in the same direction or in a large circle so that children may all swing toward the center of the circle. Moreover, conventional swings generally offer a single play opportunity—the act of swinging. The rotatable play device of the present disclosure provides a new play opportunity by which a user is able to experience the act of swinging in combination with additional social play opportunities—shared rotation and optionally either (1) a shared and alternating bouncing motion or (2) an independent bouncing motion.

SUMMARY OF THE INVENTION

Embodiments of the present disclosure are directed to a rotatable play device that comprises a central support post, a hub rotatably mounted to an upper end of the support post, and an arm assembly attached to the hub and comprising a plurality of arms, the distal end of each of the plurality of arms supporting a swing seat. Rotation of the hub about the central support post causes the plurality of seats to move around the central support post in a circular or substantially circular swing path. Moreover, one or more springs positioned on or within the hub provide each arm, and hence the seat suspended from each arm, with a bouncing, i.e. up and down, motion. In some embodiments, each seat may also be configured to swing to and fro in line with the circular or substantially circular swing path.

In some embodiments, the arm assembly may comprise a first arm and a second arm that share a common, alternating up-and-down motion. The first arm and the second arm may extend away from the hub in opposing directions. As an occupant of a seat pushes up off of the ground, the distal end of the arm from which that seat is suspended may move upward. That same motion may cause the distal end of the opposing arm to move downward. For instance, as an occupant of a seat suspended from the distal end of the first arm pushed upward, the distal end of the second arm may be moved downward. A spring, which is actuated by this movement of the arm assembly, may then create a reciprocal countermovement which causes the distal end of the first arm to move downward and the distal end of the second arm to move upward. This alternating movement may repeat a number of times (with each of lessening intensity than the previous) depending on the characteristics of the spring and the amount of force with which the movement was initiated. Moreover, as a seat moves downward, an occupant may push up off of the play surface, creating a bouncing movement of greater intensity and restarting the cycle of alternating up and down movements. Embodiments of the rotatable play device thus provides occupants of the first and second seats with a shared, reciprocal up and down movement, in addition to a shared rotational movement.

In some embodiments, the arm assembly may comprise multiple pairs of opposing arms that operate in this manner. For instance, the arm assembly may comprise (i) a first pair of arms (i.e. first and second arms) extending from the hub in opposing directions and associated with a (first) spring element that provides the arms with a shared and reciprocal bouncing motion and (ii) a second pair of arms (i.e. third and fourth arms) extending from the hub in opposing directions and associated with a (second) spring element that provides the arms with a shared and reciprocal bouncing motion.

In other embodiments, the arm assembly may comprise a plurality of arms, each of which is configured to have an independent bouncing motion. In some embodiments, for example, the arm assembly may comprise at least a first arm and a second arm, each of which extends away from the hub. Each arm may be connected to the hub by both a pivot and a spring.

As an occupant of a seat placed his or her weight onto a seat, the arm may rotate downward about the pivot such that the distal end of the arm from which that seat is suspended may move downward. The downward rotation of the arm may actuate (compress) the spring associated with that arm. Actuation of the spring may create a reciprocal force (expansion of the spring back toward its rest position) which causes the arm to rotate back upward about the pivot, causing the distal end of the arm and the suspended seat to move upward. This alternating movement may repeat a number of times (with each of lessening intensity than the previous) depending on the characteristics of the spring and the amount of force with which the movement was initiated. Moreover, as a seat moves downward, an occupant may push up off of the play surface, creating a bouncing movement of greater intensity and restarting the cycle of alternating up and down movements.

In some embodiments, the rotatable play device may also comprise one or more motion limiters. A motion limiter is configured to limit the movement of at least one of the plurality of seats in at least one direction. For example, the motion limiter may limit movement of a seat in a direction toward the support post, a direction away from the support post, or both. In some embodiments, for example, the motion limiter may be configured so that the seat cannot substantially swing toward the support post. For instance, the motion limiter may confine a seat to a range of motion toward the central support post of 10° or less, relative to a vertical axis, alternatively 5° or less, alternatively 2° or less. Similarly, in some embodiments, the motion limiter may be configured so that movement of the seat away from the central support post is limited to a desired degree. For instance, the motion limiter may confine a seat to a range of motion away from the central support post of 45° or less, relative to a vertical axis, alternatively 40° or less, alternatively 35° or less, alternatively 30° or less.

One or more of the plurality of seats may be connected to an arm by a motion limiter. In some embodiments, for example, each of the plurality of seats may be connected to an arm by a motion limiter. For instance, a mounting element of a seat may comprise a shaft and a distal end portion of an arm may comprise a hub. The shaft and the hub may be configured so the shaft rotates inside the hub only within a defined range.

In addition to the plurality of seats rotating in a circular swing path around the central post and sharing a reciprocal bouncing motion, one or more of the plurality of seats may also be configured to swing in a "to and fro" manner. For instance, at least one of the plurality of seats may be configured to swing to and fro in a direction that is in substantial alignment with the circular swing path around the central support post. In some embodiments, each of the plurality of seats may be configured to swing to and fro in substantial alignment with the circular swing path around the central support post. In this manner, the rotatable play device allows a user to experience the act of swinging in combination with (a) movement along the circular swing path provided by rotation of the hub about the central support post and (b) movement up and down provided by the arm assembly being associated with one or more spring elements.

Each of the plurality of seats may be selected to provide a unique play experience. In some embodiments, one or more of the seats may comprise a disc seat that is suspended by a flexible cable. One or more of the seats may also be configured for a child with limited physical abilities or for a young child such as a child of infant or toddler age. For instance, one or more of the seats may include some manner of restraint that prevents the child from falling from the seat and/or some manner of support that assists the child in sitting in an upright position. Non-limiting examples of seats of this sort include bucket swing seats, chair swing seats, and inclusive play seats.

In some embodiments, the central support post may extend vertically from the play surface (e.g., the ground) and the hub may define a rotation axis that is substantially aligned with a vertical axis. Where the rotation axis is aligned with a vertical axis, the plurality of seats may rotate around the central support post in a substantially circular swing path that is parallel with the play surface. In other embodiments, however, the hub may define a rotation axis that is tilted relative to the vertical axis. For instance, the hub may define a rotation axis that is tilted at an angle between about 1° and about 20° relative to a vertical axis, alternatively between about 5° and about 15°. Where the rotation axis is tilted relative to the vertical axis, the plurality of seats may rotate around the central support post in a substantially circular swing path that is not parallel with the play surface. Rather, as a seat travels along the circular swing path, the seat will be lifted higher off of the play surface (e.g., the ground) when on a first side of the central support post than when on the second side of the central support post. These tilted embodiments may allow one or more users to maintain rotation of the hub in a largely self-sustaining manner, such as by a coordinated shifting of weight during rotation through the substantially circular swing path.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
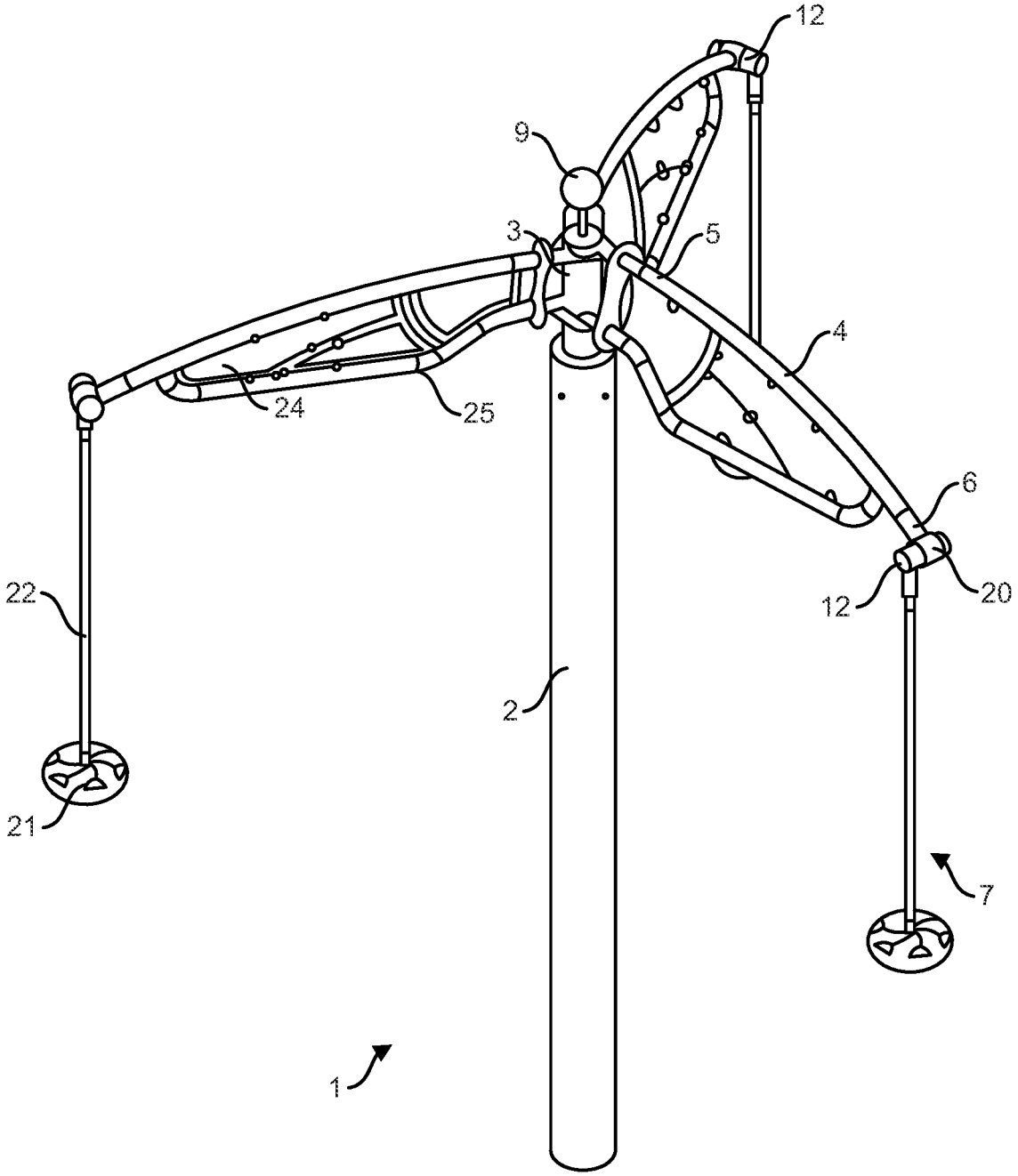
FIG. 1 is a perspective view of an embodiment of the rotatable play device.

Embodiments of the present disclosure are directed to a play device 1 in which a plurality of seats 7 rotate around a central support post 2 in a substantially circular swing path. An embodiment of a play device 1 in accordance with the present description is shown in FIGS. 1 to 3.

The play device 1 comprises a central support post 2 and a hub 3 which is rotatably mounted to an upper end of the central support post. The play device 1 also comprises a plurality of arms 4 extending away from the central support post 2. Each arm 4 has a proximal end 5 that is attached to the hub 3 and a distal end 6 that is configured to support a seat 7. The play device 1 also comprises a plurality of seats 7, with each swing seat being suspended from the distal end 6 of one of the arms 4.

The play device 1 is configured so that one or more users may cause the hub 3 to rotate, causing the seats 7 to rotate around the central support post 2 in a substantially circular swing path. This rotation can be initiated, for example, by using ones legs to push off the play surface (e.g., the ground) while seated on one of the seats 7 or by moving one of the swing seats through a portion of the circular swing path before sitting on the seat. A semi-continuous rotation can be maintained by one or more users simply by occasionally pushing off the play surface in the direction of the rotation. The rotation can also be initiated or maintained by a caretaker or other bystander providing an assistive force, e.g. a push. The play device 1 preferably comprises no motors and that rotation is initiated and maintained solely by the physical action of users and/or bystanders. It is also preferable that rotation of the plurality of seats 7 through the substantially circular swing path may be easily achieved by users of many different ages, so that children of many ages can utilize the play opportunities presented by the play device 1.

Figure 2:
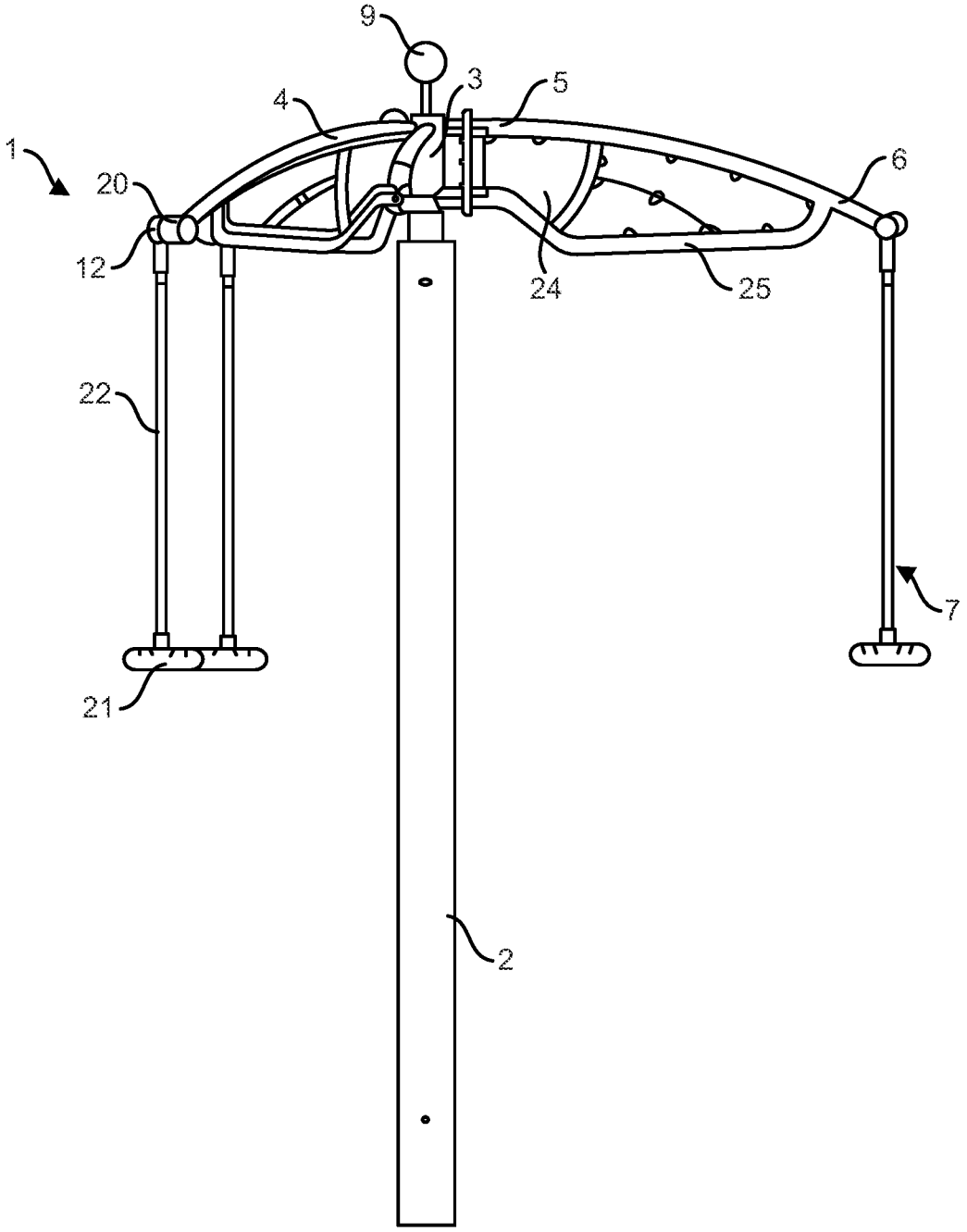
FIG. 2 is an elevation view of an embodiment of the rotatable play device.
Figure 3:
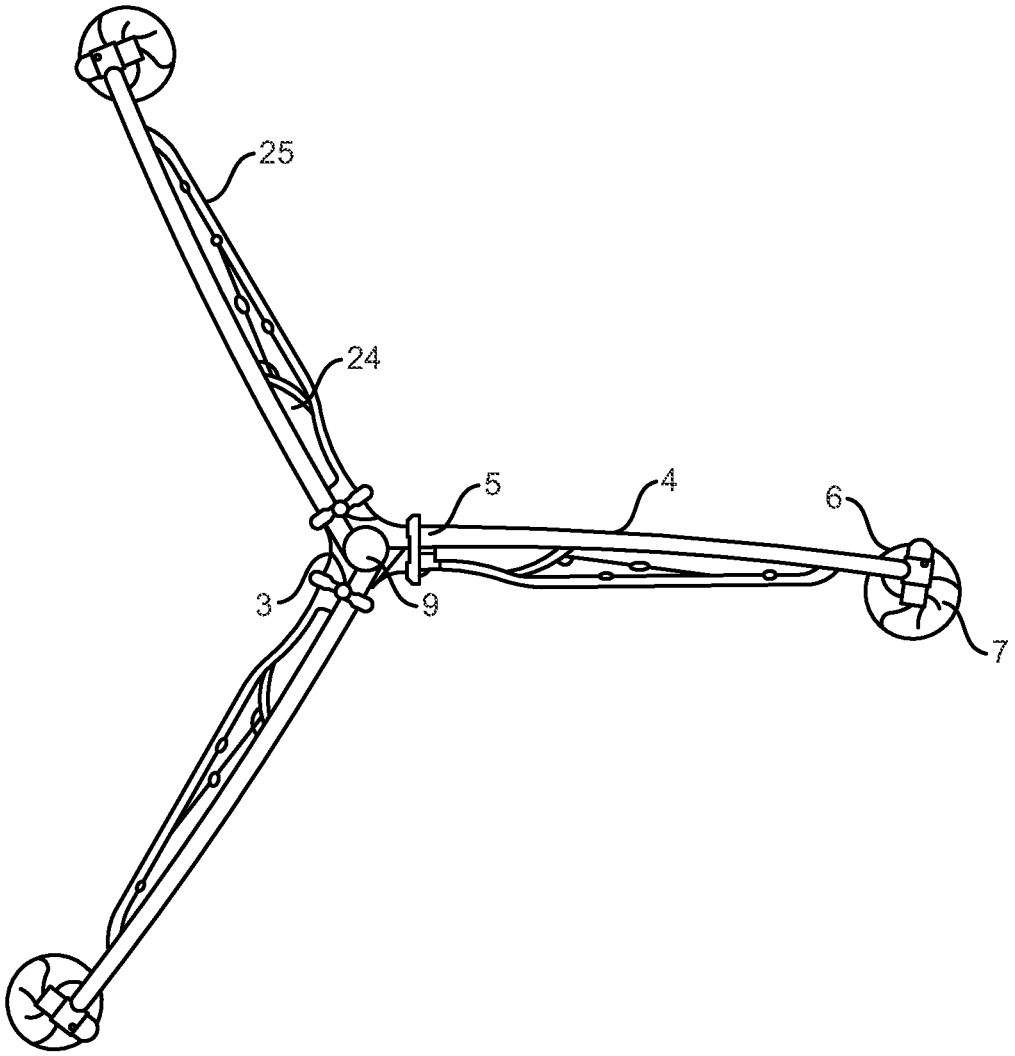
FIG. 3 is a top plan view of an embodiment of the rotatable play device.

In some embodiments, such as that illustrated in the FIGS. 1 to 3, the play device 1 may have three arms 4. In other, non-illustrated, embodiments, the play device 1 may have a different number of arms 4. For instance, the play device 1 may comprise two arms 4, four arms, five arms, six arms, seven arms, eight arms, or more. In some embodiments, the play device 1 may have greater than two arms 4. The number of arms 4 may be selected to provide a play experience that may be shared by a desired number of children. As the number of arms 4 is increased, however, the length of the arms may need to be increased in order to ensure that the seats 7 are positioned at a safe and fun distance from one another. In addition to requiring valuable playground space, this may require each of the arms 4 to have an increased strength. A play device 1 having between three and five arms 4, and in particular a play device having three arms, has been found to be particularly functional.

The plurality of arms 4 may desirably be equidistantly spaced from one another. For instance, the proximal end 5 of each arm may be equidistantly spaced around the circumference of the hub 3. The hub 3 is preferably configured so that the weight of the plurality of arms 4 and the plurality of seats 7 is substantially evenly distributed. In this way, the play device 1 may be easily operated to provide rotation in a semi-continuous manner with the exertion of little effort. By substantially evenly distributing the weight among the plurality of arms 4, rotation of the hub 3 about the central support post 2 may easily be initiated and maintained by one or more users. For instance, in the embodiment shown in FIGS. 1 to 3, semi-continuous rotation may easily be achieved by a single user, by two users, or by three or more users. Where each of the plurality of seats 7 is substantially identical, such as is shown in FIGS. 1 to 3, the weight may be substantially evenly distributed by securely attaching each of the plurality of arms 4 to the hub 3. Where one or more of the plurality of seats 7 differs from another, additional steps may be required. For instance, additional weight may be added to or removed from one or more of the arms 4 in order to counteract a relatively light seat 7 or a relatively heavy seat 7.

In some embodiments, such as that illustrated in FIGS. 1 to 3, the hub 3 may define a rotation axis that is substantially aligned with a vertical axis. Where the rotation axis is aligned with a vertical axis, the plurality of seats 7 may rotate around the central support post 2 in a substantially circular swing path that is parallel with the play surface (i.e., the plane defined by the circular swing path is parallel with the play surface). In other, non-illustrated, embodiments, the hub 3 may define a rotation axis that is tilted relative to the vertical axis. For instance, the hub 3 may define a rotation axis that is tilted at an angle between about 1° and about 20° relative to a vertical axis, alternatively between about 5° and about 15° relative to a vertical axis. Where the rotation axis is tilted relative to the vertical axis, the plurality of seats 7 may rotate around the central support post 2 in a substantially circular swing path that is not parallel with the play surface (i.e., the plane defined by the circular swing path is not parallel with the play surface). Rather, as a seat 7 travels along the circular swing path, the seat 7 will be lifted higher off of the play surface (e.g., the ground) when on a first side of the central support post 2 than when on the second side of the central support post. These tilted embodiments may allow one or more users to maintain rotation of the hub 3 in a largely self-sustaining manner, such as by a coordinated shifting of weight during rotation through the substantially circular swing path.

Figure 4:
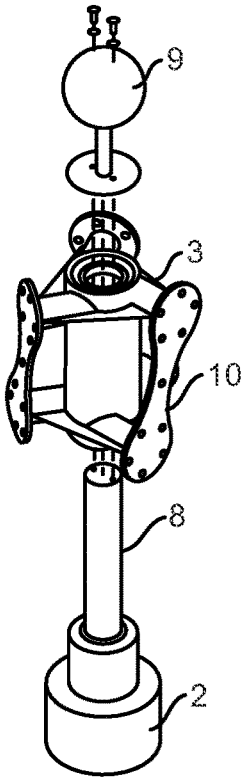
FIG. 4 is an exploded view of the central hub and the upper end of the support post in accordance with an embodiment of the rotatable play device.

The hub 3 may be rotatably mounted to an upper end of the support post 2 in any number of manners, as could be envisioned by a person of ordinary skill in the art from the present disclosure. One non-limiting manner of rotatably mounting the hub 3 to the upper end of the support post 2 is shown in FIG. 4. In this embodiment, the hub 3 is supported by the upper end of the central support post 2. The hub 3 comprises an internal bearing assembly which surrounds and rotates on a head 8 of the upper end of the support post 2. The hub 3 may be secured to the upper end of the support post 2 by a top cover 9. As illustrated in FIG. 4, for instance, the top cover 9 may be secured to the head 8 of the support post 2 using one or more conventional fasteners. The top cover may take on any shape and size, and may be selected for instance to coincide with a particular playground theme.

In embodiments in which the hub defines a rotation axis that is tilted with respect to vertical, one of the support post 2 and the hub 3 may comprise a tilted portion. Alternatively, the hub 3 may be mounted to the upper end of the support post 2 via one or more tilted connecting elements. For example, a connecting element having a head portion tilted at the desired rotation angle may be secured to the upper end of the substantially vertical support post 2 and the hub 3 may comprise an internal bearing assembly that is configured to rotate on the head of the connecting element to produce a rotation axis that is tilted with respect to vertical. Alternatively, the connecting element may have an internal bearing assembly that surrounds and rotates on a head 8 of the upper end of the substantially vertical support post 2 and the hub 3 may be secured to a tilted portion of the connecting element so that rotation of the connecting element about the vertical axis is translated to provide a rotation axis that is tilted with respect to vertical.

Figure 5:
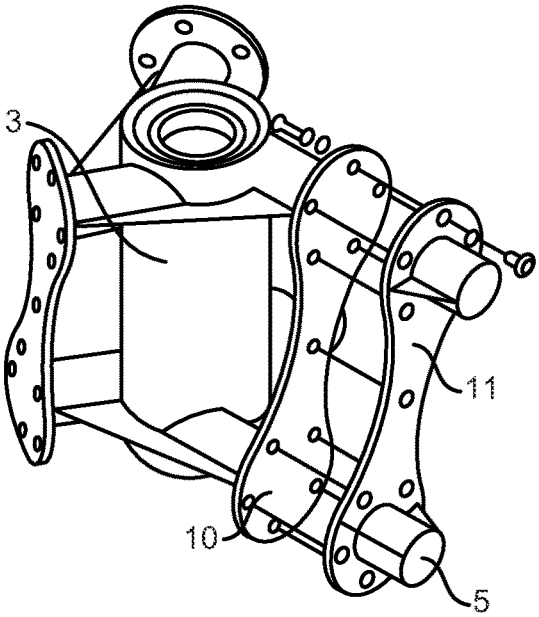
FIG. 5 is an exploded view of the central hub and the proximal end of an arm in accordance with an embodiment of the rotatable play device.

The plurality of arms 4 may be attached to the hub 3 in any number of manners, as could be envisioned by a person of ordinary skill in the art from the present disclosure. One non-limiting manner of attaching the proximal end 5 of each of the arms 4 to the hub 3 is shown in FIG. 5. In this embodiment, the hub comprises a number of mounting plates 10 that correspond with the number of arms 4 of the play device 1. The proximal end 5 of each arm 4 comprises a mounting plate 11 that is configured for attachment to one of the hub's mounting plates 10. The mounting plate 11 may be affixed to the distal end 5 of the arm 4, such as through conventional methods, or the mounting plate may be integral with the distal end of the arm. As in the embodiment shown in FIG. 5, the mounting plate 11 may extend beyond and create a periphery that surrounds the framework of the arm 4 to provide a readily accessible surface for securing to the hub 3. Similarly, the mounting plate 10 on the hub 3 may extend from the hub so as to have a readily accessible back surface for the attachment of a fastener component (e.g., bolts or nuts). Inclusion of these easily-accessible surfaces on each of the mounting plates 10, 11 provides for an increased ease of assembly.

Moreover, each of the mounting plates 10, 11 may have a relatively large surface area configured for fastening of the arm 4 to the hub 3 at a plurality of locations in order to ensure that weight is substantially evenly distributed throughout the plurality of arms. For instance, each of the hub's mounting plates 10 may extend substantially the entire height of the hub 3. The mounting plate 11 on the proximal end 5 of the arm 4 may also extend substantially the height of the hub 3. The two mounting plates 10, 11 may be secured together using one or more conventional fasteners, such as bolts or the like. To ensure a substantially even distribution of weight, the two mounting plates 10, 11 are preferably secured together by a plurality of fasteners. For instance, in the embodiment shown in FIG. 5, the two mounting plates 10, 11 are secured together with multiple fasteners positioned around each portion of the framework of the arm 4 and along the entire height of the mounting plates. Different numbers and positioning of fasteners is also contemplated, especially where the mounting plates 10, 11 may have different configurations from that shown in FIG. 5. It is also contemplated that, in some embodiments, each of the arms 4 may be integrally formed with the hub 3.

Figure 6:
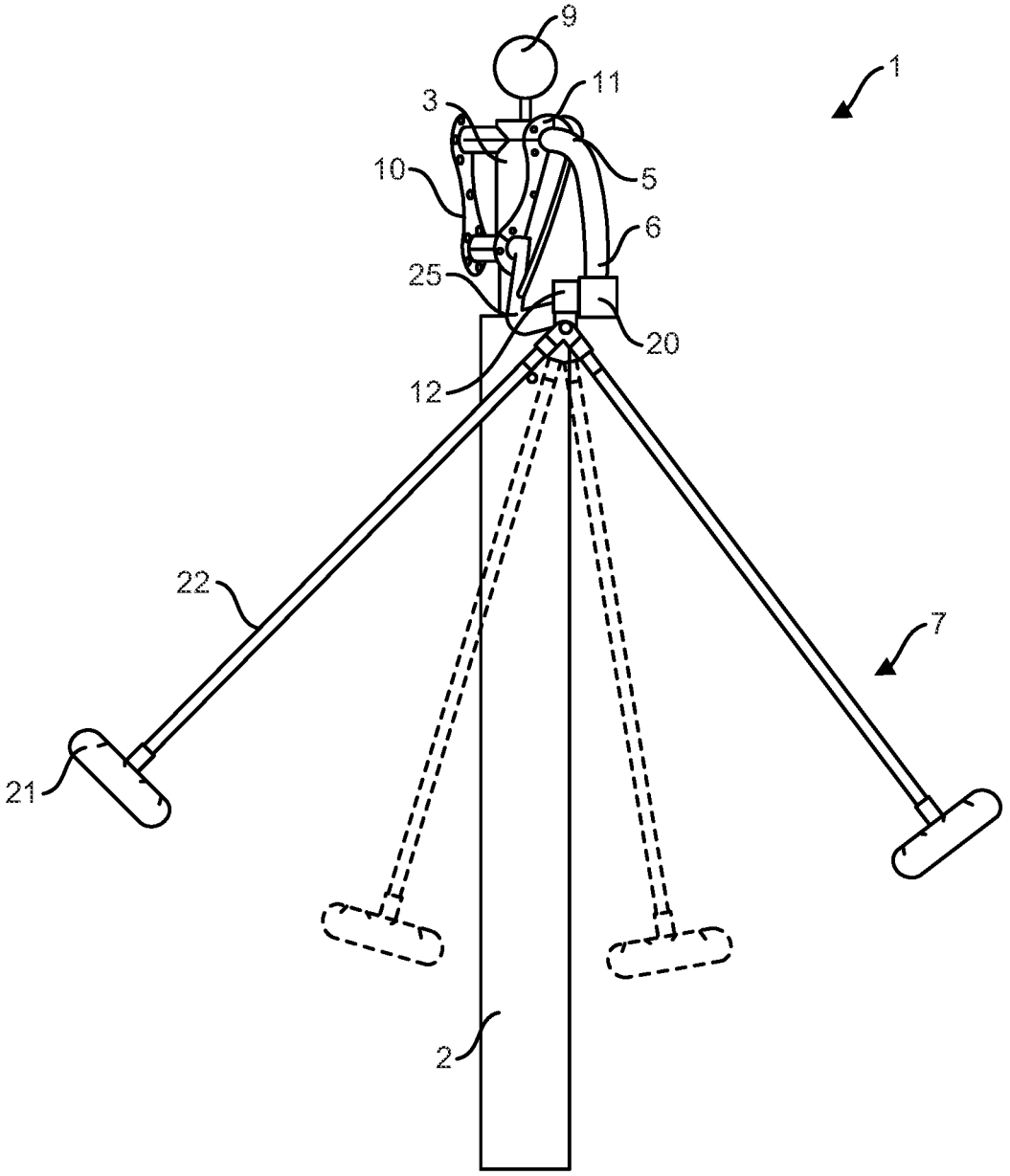
FIG. 6 is an elevation view of the rotatable play device, showing a swing seat that is configured to swing in substantial alignment with the circular swing path in accordance with an embodiment of the rotatable play device.

In addition to rotation around the central support post 2, one or more of the seats 7 may also be configured to swing from the distal end 6 of the arm 4. For instance, one or more of the seats 7 may be configured to swing in a "to and fro" motion in one or more directions. In some embodiments, one or more of the seats 7 may be configured to swing to and fro in substantial alignment with the circular swing path. A seat 7 swinging in a to and fro manner in substantial alignment with the circular swing path is shown in FIG. 6. Because the swinging motion is in substantial alignment with the circular swing path, the swinging motion does not itself bring the seat either substantially closer to or substantially farther away from the central support post 2. Note that in some embodiments, such as where the seat 7 is suspended by a flexible cable for example, the manner by which the seat 7 is suspended from the proximal end 6 of the arm 4 necessarily allows for a small degree of movement of the seat in multiple (e.g., all) directions. While a user may utilize this inherent flexibility to slightly alter the "to and fro" motion, the overall motion would still be considered to be in substantial alignment with the circular swing path. In some embodiments, each of the plurality of seats 7 may be configured to swing in a "to and fro" manner as described above.

Figure 7:
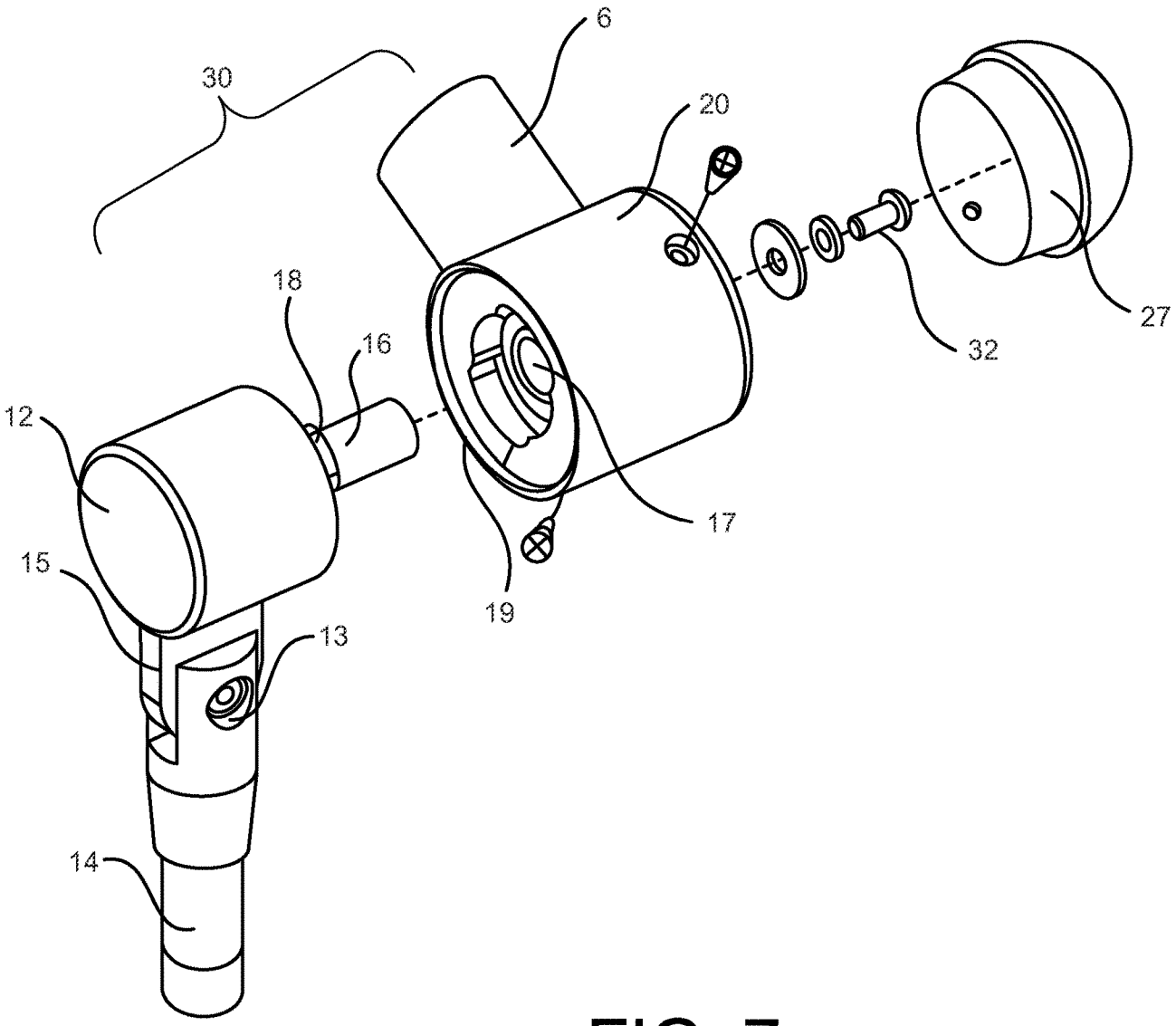
FIG. 7 is an exploded view of the distal end of an arm and the seat mounting element, showing a motion limiter in accordance with an embodiment of the rotatable play device.

One or more of the seats 7 may be configured to swing in a "to and fro" manner in any number of ways, as could be envisioned by a person of ordinary skill in the art from the present disclosure. In some embodiments, the seat assembly 7 may comprise a mounting element 12 having a hinge 13 that provides for a "to and fro" swinging motion. An example of such a mounting element 12 is shown in FIG. 7. In the embodiment illustrated in FIG. 7, a seat suspension component 14 is connected to a portion of the mounting element 12 by a hinge 13. In particular, the mounting element 12 comprises a downward-extending portion 15 that mates with the seat suspension component 14 in a hinged manner. In the embodiment illustrated in FIG. 7, the seat suspension component 14 is affixed to the first end of a flexible cable 22 and the second end of the flexible cable is attached to a disc seat 21. Accordingly, movement of the seat suspension component 14 about the hinge 13 may be caused by (and provides for) a swinging motion of a user sitting on the disc seat 21.

In some embodiments, such as that illustrated in FIG. 7, the hinge 13 only allows "to and fro" swinging in a substantially single direction, for example in a plane that substantially corresponds with the circular swing path defined by rotation of the hub 3 about the central support post 2. For example, the hinge 13 may be configured (for example by being aligned substantially parallel to the longitudinal axis of the arm 4) so that the seat suspension component 14 moves about the hinge to create a swinging motion in a direction that is perpendicular with the arm. Thus, as the arm 4 rotates about the central support post 2, the swinging motion will always be substantially aligned with the circular swing path created by the rotation of the hub 3 about the central support post 2. In some embodiments, the hinge 13 assembly may also be configured to restrict the degree the height to which the seat may swing during the "to and fro" swinging action. For example, the hinge 13 assembly may only allow the seat to swing 50° or less relative to a vertical axis (meaning that the maximum angle formed between the swing seat and a vertical axis is between 0° and 50°), alternatively 45° or less, alternatively 40° or less, alternatively 35° or less, alternatively 30° or less, or the like.

Where one or more of the seats 7 is configured to swing in a "to and fro" motion, it may become important that the play device 1 meet all requisite standards for playground swings, such as all ASTM standards for playground swings.

In some embodiments, one or more of the seats 7 may be configured to swing in a direction toward the central support post 2, away from the central support post, or both. However, in some embodiments, the play device 1 may comprise one or more motion limiters 30. A motion limiter 30 is configured to limit the range of motion of a seat 7. For example, one or more seats 7 may be equipped with a motion limiter 30 that is configured to limit the seat's range of motion in a direction toward the central support post, in a direction away from the central support post, or both. In some embodiments, each of the plurality of seats 7 may comprise a motion limiter 30.

In some embodiments, it may be desirable to limit motion of one or more of the swing seats 7 toward the central support post 2 so as to avoid dangerous situations and/or possible collisions. In some embodiments, the motion limiter 30 may be configured so that one or more of the seats 7 cannot substantially swing in a direction toward the central support post 2. Note that in some configurations, such as where the seat 7 is suspended by a flexible cable for example, the manner by which the seat 7 is suspended from the proximal end 6 of the arm 4 may necessarily allow for a small degree of movement of the seat in multiple (e.g., all) directions. While a user may utilize this inherent flexibility to achieve a small degree of movement toward the central support post 2, the motion limiter 30 may nevertheless be understood as configured such that the seat 7 cannot substantially swing in a direction toward the central support post. In some embodiments, the motion limiter 30 may be configured so that movement of a seat 7 in a direction toward the central support post 2 is limited to 20° or less relative to a vertical axis (meaning that the maximum angle formed between the swing seat and a vertical axis is between 0° and 20°), alternatively 15° or less, alternatively 10° or less, alternatively 5° or less, alternatively 2° or less.

Figure 10:
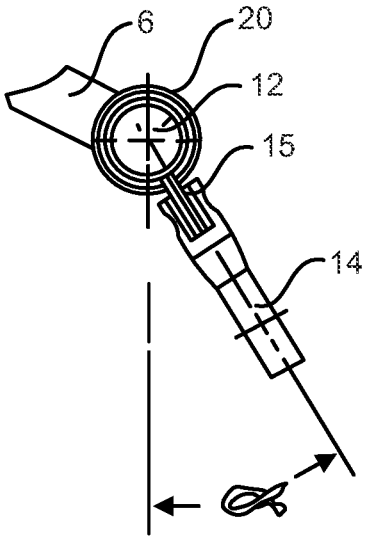
FIG. 10 is a side elevation view of the distal end of the arm and the seat mounting element, demonstrating the operation of a motion limiter in accordance with an embodiment of the rotatable play device.

In some embodiments, it may be desirable to limit motion of one or more of the swing seats 7 away from the central support post 2. Motion of the seats 7 away from the support post 2 will naturally occur due to centripetal forces caused by rotation of the swing seats around the central support post. However, it may be desirable to limit this motion for the safety of users and/or bystanders. Accordingly, the motion limiter 30 may be configured so that a swing seat 7 has a limited range of motion in a direction away from the support post 2. In some embodiments, for example, the motion limiter 30 may be configured so that movement of the seat 7 in a direction away from the support post 2 is limited to an angle $\alpha$ relative to a vertical axis. This effect is illustrated in FIG. 10. For instance, the motion limiter 30 may be configured so that movement of the swing seat in a direction away from the support post 2 is limited to 45° or less relative to a vertical axis (meaning that the maximum angle formed between the swing seat and a vertical axis is between 0° and 45°), alternatively 40° or less, alternatively 35° or less, alternatively 30° or less, alternatively 25° or less, alternatively 20° or less.

In some embodiments, it may be desirable to limit motion of the swing seats 7 both in a direction toward the central support post 2 and in a direction away from the central support post. In some embodiments, for example, the motion limiter 30 may be configured to limit motion of the swing seat 7 toward the central support post 2 to a first degree, such as described above, and to limit motion of the swing seat away from the central support post to a second degree, such as described above. In the embodiment illustrated in FIG. 10, for example, the motion limiter 30 is configured so that the seat 7 cannot swing in a direction toward the central support post 2 (to the left of the Figure) and so that the seat is limited to a swinging motion within an angle of 30° from vertical in a direction away from the central support post (to the right of the Figure).

The motion limiter 30 may take on any of a number of configurations. In some embodiments, the seat assembly 7 may be connected to the distal end 6 of the arm 4 by a motion limiter 30. For instance, a mounting element 12 of the seat assembly 7 may be attached to a distal end component 20 of the arm through a motion limiter 30, which may be configured so that the mounting element 12 may only rotate within a predetermined and defined range in relation to the distal end component 20. An example of such an assembly is shown in FIG. 7.

As shown in FIG. 7, the mounting element 12 of the seat assembly 7 may comprise a shaft 16 and the distal end component 20 may comprise an aperture 17. For example, the shaft 16 may be integral with and extend from an end of the mounting element 12. The distal end component 20 may comprise an internal element defining the aperture 17. The internal element may be integral with the distal end component 20 or it may be secured within the distal end component by any conventional manner, such as friction fit, one or more conventional fasteners, or the like. Additionally, the distal end component 20 may be either integral with the distal end 6 of the arm 4 or secured to the distal end of the arm, such as by one or more conventional fasteners or the like. In some embodiments, the internal element may be secured within the distal end component 20 and the distal end component may be affixed to the distal end 6 of the arm 4 by the same one or more fasteners.

Figure 8:
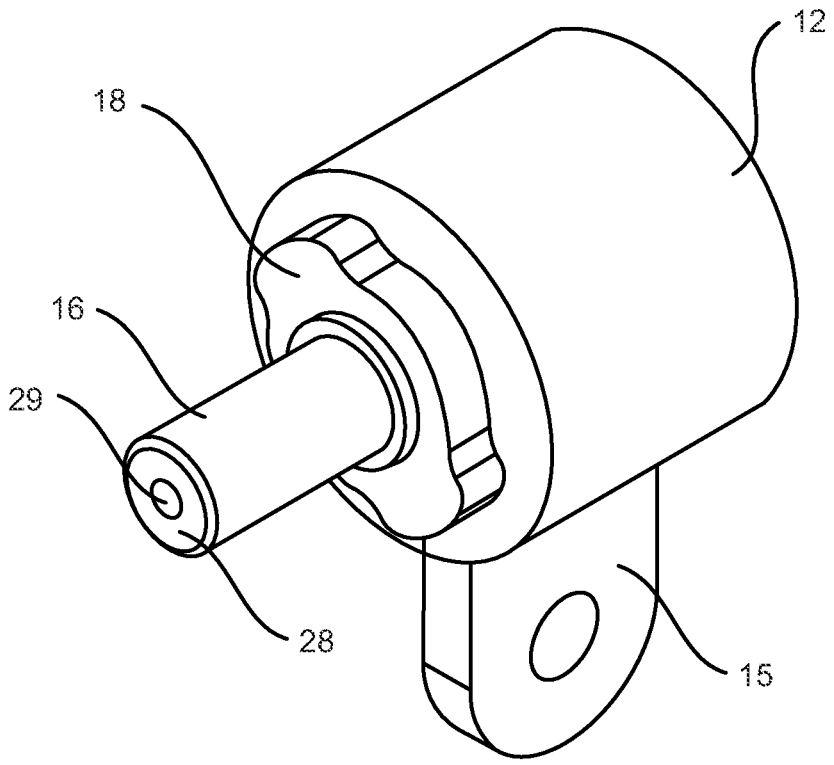
FIG. 8 is a perspective view of a seat mounting element in accordance with an embodiment of the rotatable play device.

The shaft 16 may be rotatably affixed to the distal end component 20. For instance, the shaft 16 may extend into and substantially through the aperture 17, such that the front surface 28 of the shaft 16 may be affixed to the distal end component 20 by one or more conventional fasteners, such as screws and the like. As illustrated in FIG. 8, for example, the front surface 28 of the shaft 16 may comprise an opening 29 having an internal thread. Accordingly, as illustrated in FIG. 7, a screw 32 (having an external thread) may be inserted through a portion of the distal end component 20 and into the opening 29 on the front surface 28 of the shaft 16, securing the mounting element 12 to the distal end component 20 (but allowing for rotation of the mounting element 12 about the distal end component 20). A cover element 27 may be placed over the fastener, e.g. the screw 32, in order to protect it from both the environment and potential tampering.

Figure 9:
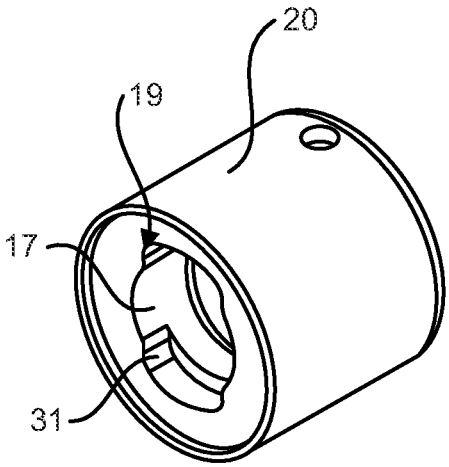
FIG. 9 is a perspective view of a distal end component of an arm in accordance with an embodiment of the rotatable play device.

The shaft 16 and the aperture 17 may be configured so that the shaft rotates inside the aperture within a predetermined and defined range. Rotation of the shaft 16 within the aperture 17 may be restricted in a number of ways. As shown in FIG. 8, for instance, the mounting element 12 may have one or more projecting portions 18. Although the projecting portions 18 of the mounting element 12 are shown extending from the body of the mounting element 12, in other embodiments the one or more projecting portions may extend from a portion of the shaft 16 itself. As shown in FIG. 9, the aperture 17 may have one or more cutaway portions 19 that are designed to accept the one or more projecting portions 18. The one or more cutaway portions 19 define a length within which the one or more projecting portions 18 are able to travel. At either end of that defined length, the cutaway portion comprises a stop element 31, such as a ledge or the like. When the mounting element 12 rotates to a desired maximum degree, the one or more projecting portions 18 abut against stop elements 31 of the one or more cutaway portions 19, which prevents rotation of the mounting element beyond that desired maximum degree. Accordingly, rotation of the mounting element 12 is restricted to occur only within the lengths of the one or more cutaway portions 19.

While the embodiment illustrated in FIGS. 7 through 9 comprises two complementary projections 18 and cutaways 19, other embodiments may comprise only one complementary projection 18 and cutaway 19. Yet other embodiments may comprise three, four, or greater than four complementary projections 18 and cutaways 19.

The play device 1 may comprise any number of different types of seats 7, as could be envisioned by a person of ordinary skill in the art from the present disclosure. In some embodiments, such as that illustrated in FIGS. 1 to 3, one or more of the seats 7 may comprise a disc seat 21. The disc seat 21 may comprise a relatively hard central base that is surrounded by a relatively soft material, the relatively soft material providing cushioning in case a seat were to come into contact with a person during rotation and/or a swinging motion. In some embodiments, for example, a disc seat 21 may comprise an aluminum base that is surrounded by a foamed material. The foamed material may also be coated with a sealant that is configured to withstand playground environment and use. A disc seat 21 having this construction may be configured to meet requisite ASTM impact standards.

Other types of swing seats 7, including but not limited to those described below, are also contemplated. For instance, one or more of the seats 7 may comprise a belt swing seat or a board swing seat, which are suitable for use by children and adults alike. In some embodiments one or more of the seats 7 may comprise a seat that is configured for use by a child of infant or toddler age and which provides some manner of restraint that assists in preventing the child from falling from the seat or by providing some support that assists the child in sitting upright in the seat. Some non-limiting examples of swing seats of this sort include bucket swing seats and chair swing seats.

A bucket swing seat is any seat having at least a segment of the seat that is generally shaped like a bucket, with the segment providing a restraint on the forward, backward, or lateral movement of the occupant. A full bucket seat, for example, is a bucket seat that has a peripheral wall extending around the perimeter of the seat. The full bucket seat typically comprises holes for a child's legs and requires the caretaker to lift a child and place him or her into the seat. Full bucket seats are sold, for example, under the trade names GameTime® Enclosed Tot Seat and Play&Park Structures® Fully Enclosed Tot Seat. A half bucket seat is a bucket seat that has a peripheral wall that extends only around a portion of the perimeter. Typically, the peripheral wall provides a restraint on at least the backward movement of the occupant. A half bucket seat may also include a front guard that, when closed, restrains the forward movement of the occupant.

A chair swing seat is a child swing seat having at least a bottom support and a back support, calling to mind the shape of a chair. In various embodiments, a chair swing seat may also, but does not necessarily, include a front guard, which restrains the forward movement of the child. The front guard may be integrally formed with or permanently affixed to the chair, in which case, the chair and font guard preferably comprise openings through which a child's legs extend. Preferably, the front guard is moveable between an open position, in which the child may easily be placed into or taken out of the seat, and a closed position. In some embodiments, the front guard comprises a solid component, for example a plastic or cushioned component. Solid component front guards, for example, may slide or rotate between an open and closed position. Alternatively, solid component front guards may be detached from the seat for child loading and reattached to the seat to act as a restraint. In other embodiments, the front guard may comprise a belt or harness that is fastened or clasped in place to form a restraint. Models of chair swing seats are sold, for example, under the trade names Play&Park Structures® Made-for-Me Swing Seat, BigToys® Made-for Me Swing Seat, Play&Park Structures® One-for-All Swing Seat, and BigToys® One-for-All Swing Seat.

Figure 11:
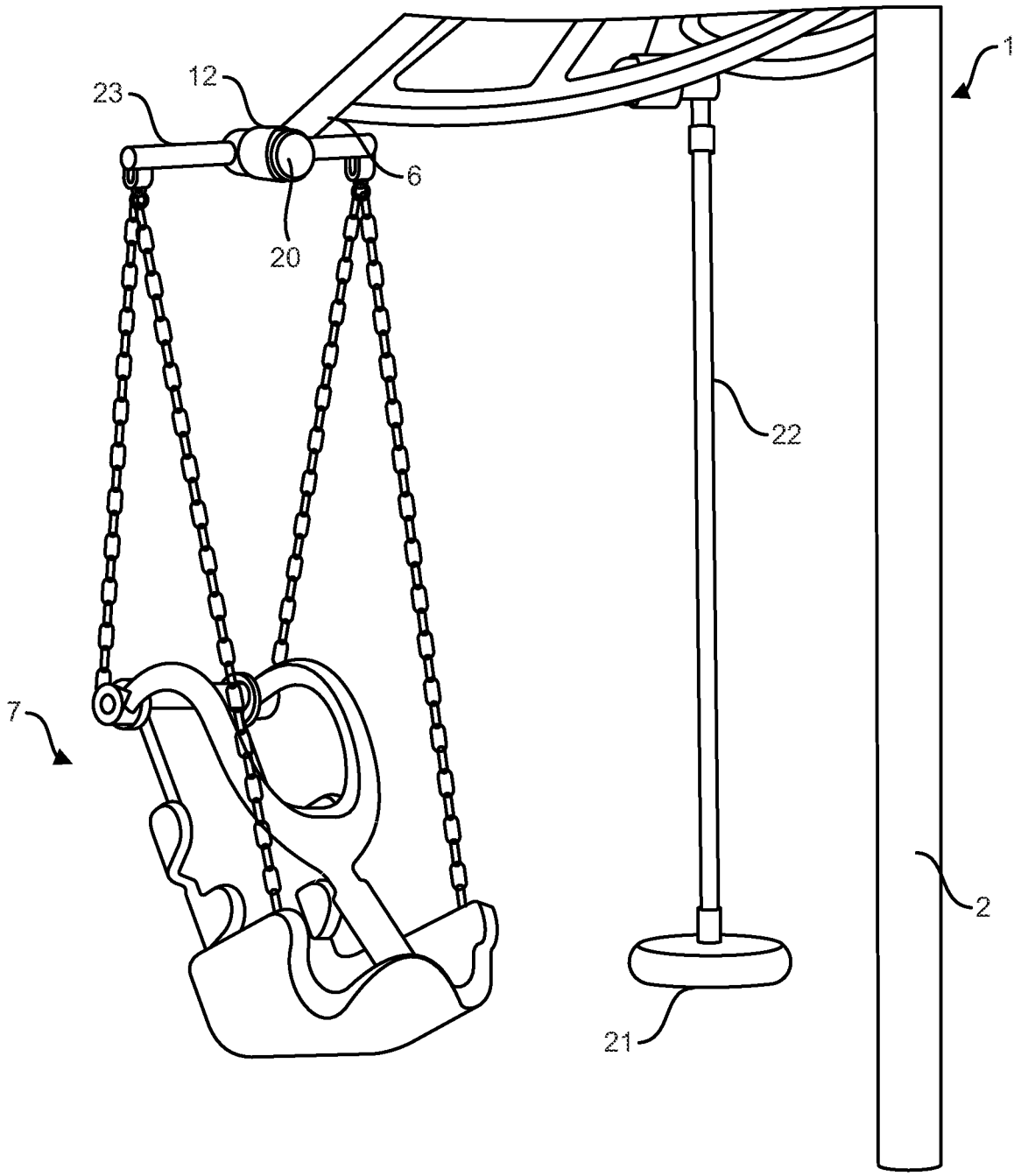
FIG. 11 is a perspective view of an embodiment of the rotatable play device in which one of the seats is configured for a child with limited physical abilities.

In some embodiments, the child swing seat may comprise a swing seat 7 that is adapted for use by children with special needs, sometimes referred to as inclusive play or adaptive swing seats. Inclusive play swing seats, for example, are configured for children that require additional support and typically have a high back, wing support, and an adjustable harness that helps a child maintain a neutral body position and minimizes fatigue. Models of inclusive play swing seats are sold, for example, under the trade names GameTime® Adaptive Swing Seat and GameTime® Zero-G Swing Chair. An embodiment of a play device of the present disclosure comprising an example inclusive play swing seat is shown in FIG. 11. The swing seat 7 shown in FIG. 11 is a child swing chair of the sort described in detail in U.S. Pat. No. 7,892,101 B1, the entirely of which is incorporated herein by reference.

Each of the plurality of seats 7 may be suspended from the distal end 6 of the arm 4 in any of a number of different ways, as could be envisioned by a person of ordinary skill in the art from the present disclosure. In some embodiments, such as where the seat 7 comprises a disc seat as shown in FIGS. 1 to 3, it may be desirable that the seat 7 is suspended from the arm 4 by a flexible cable 22, such as that shown in the illustrated embodiments. In other embodiments, including where different types of seats 7 are utilized, the manner of suspension may be different from that shown in FIGS. 1 to 3. For example, as shown in FIG. 11, the mounting element 12 of a seat assembly 7 may comprise a crossbar 23 from which the seat is suspended. In contrast to the mounting element 12 shown in FIGS. 7 and 8, a mounting element comprising a crossbar 23 provides multiple suspension points from which the seat may be suspended. Various types of swing seats 7 may be suspended from the crossbar 23 using two or more suspension points located along the length of the crossbar.

As shown in FIG. 11, the crossbar 23 may be arranged so as to be substantially parallel with the longitudinal axis of the arm 4. This provides that the swing seat 7 may be suspended from the crossbar 23 in a manner that allows for swinging of the seat in substantial alignment with the circular swing path, as described above. In other embodiments, including for example embodiments where "to and fro" swinging is not desirable, the crossbar 23 may be arranged to be substantially perpendicular to the longitudinal axis of the arm 4. The swing seat 7 may then be suspended from the crossbar 23 so as to face toward the central support post 2. In this arrangement, for example, a user of the swing seat 7 may be able to better see and interact with the users of the other seats, increasing the social play aspect of the play device 1.

In some embodiments, the play device 1 may comprise one or more additional play-enhancing features. For instance, in some embodiments, the arms 4 may comprise one or more colored, translucent panels 24. The colored, translucent panels 24 may be configured so that the sun shines through the panels to create a colored shadow on the play surface (e.g., the ground) in the vicinity of the play device 1. For instance, in some embodiments, such as the embodiment illustrated in FIGS. 1 to 3, the arm 4 may comprise a framework 25 and the colored, translucent panels 24 may be attached to the arm 4 within one or more spaces created by the framework 25. The framework 25 may take on any of a number of configurations, as could be envisioned by a person of ordinary skill in the art from the present disclosure. In the illustrated embodiment, for example, the framework 25 extends substantially below the arm and defines a plurality of different openings for the attachment of colored, translucent panels 24. In other embodiments, the framework 25 may define only a single opening for the attachment of a single panel 24.

In order to ensure that the colored ground shadow is produced in the vicinity of the play device 1, the framework 25 may be tilted relative to a vertical axis so that the sunlight shines downward through the one or more panels 24 before striking the ground in the vicinity of the play device. For instance, in some embodiments, the framework 25 may be tilted between about 5° and about 45° relative to a vertical axis, alternatively between about 5° and about 30° relative to a vertical axis, alternatively between about 10° and about 30° relative to a vertical axis, alternatively between about 10° and about 20° degrees relative to a vertical axis. The framework 25 in the embodiment illustrated in FIGS. 1 to 3 for example is tiled at an angle of about 15° degrees relative to vertical. This tilting of the framework 25 can be most clearly seen in FIG. 3.

Figure 12:
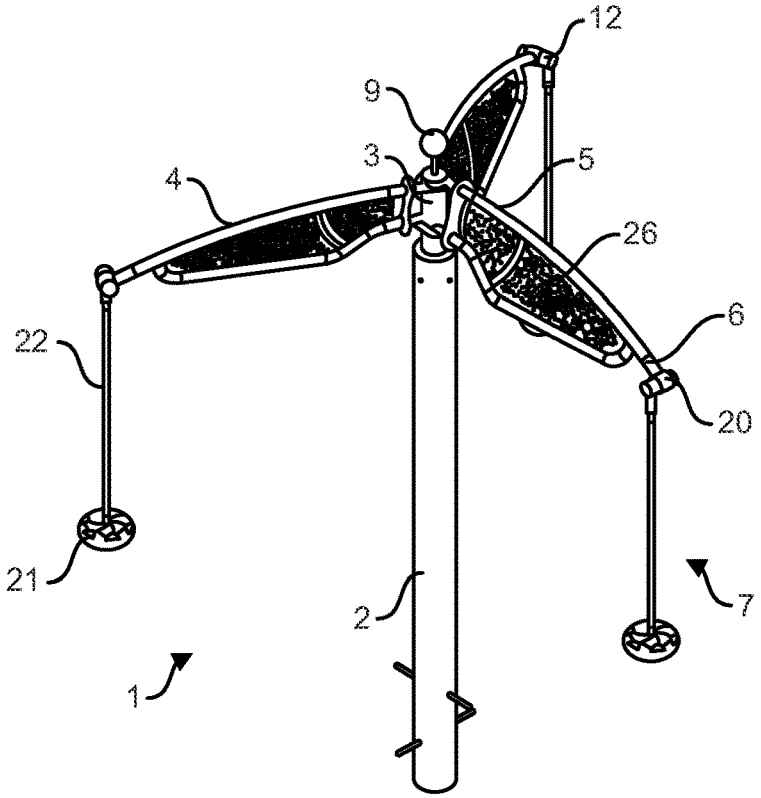
FIG. 12 is a perspective view of another embodiment of the rotatable play device.
Figure 13:
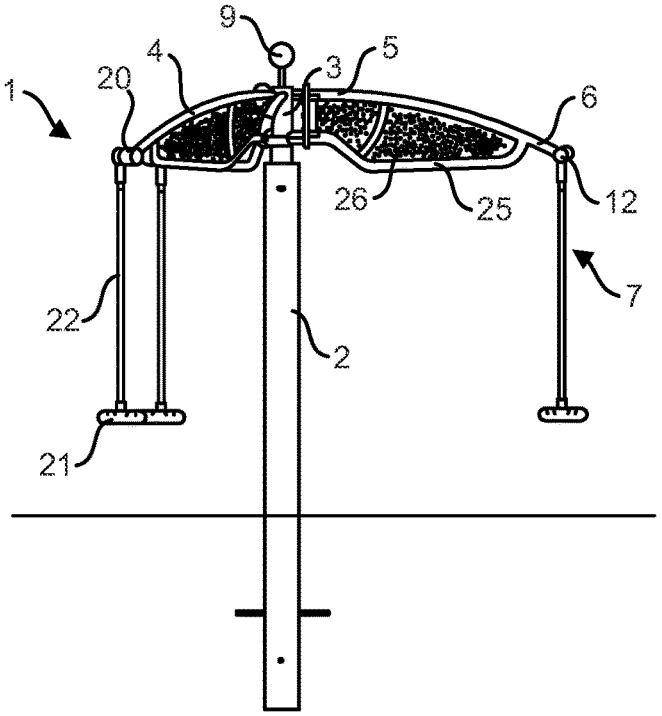
FIG. 13 is an elevation view of another embodiment of the rotatable play device.
Figure 14:
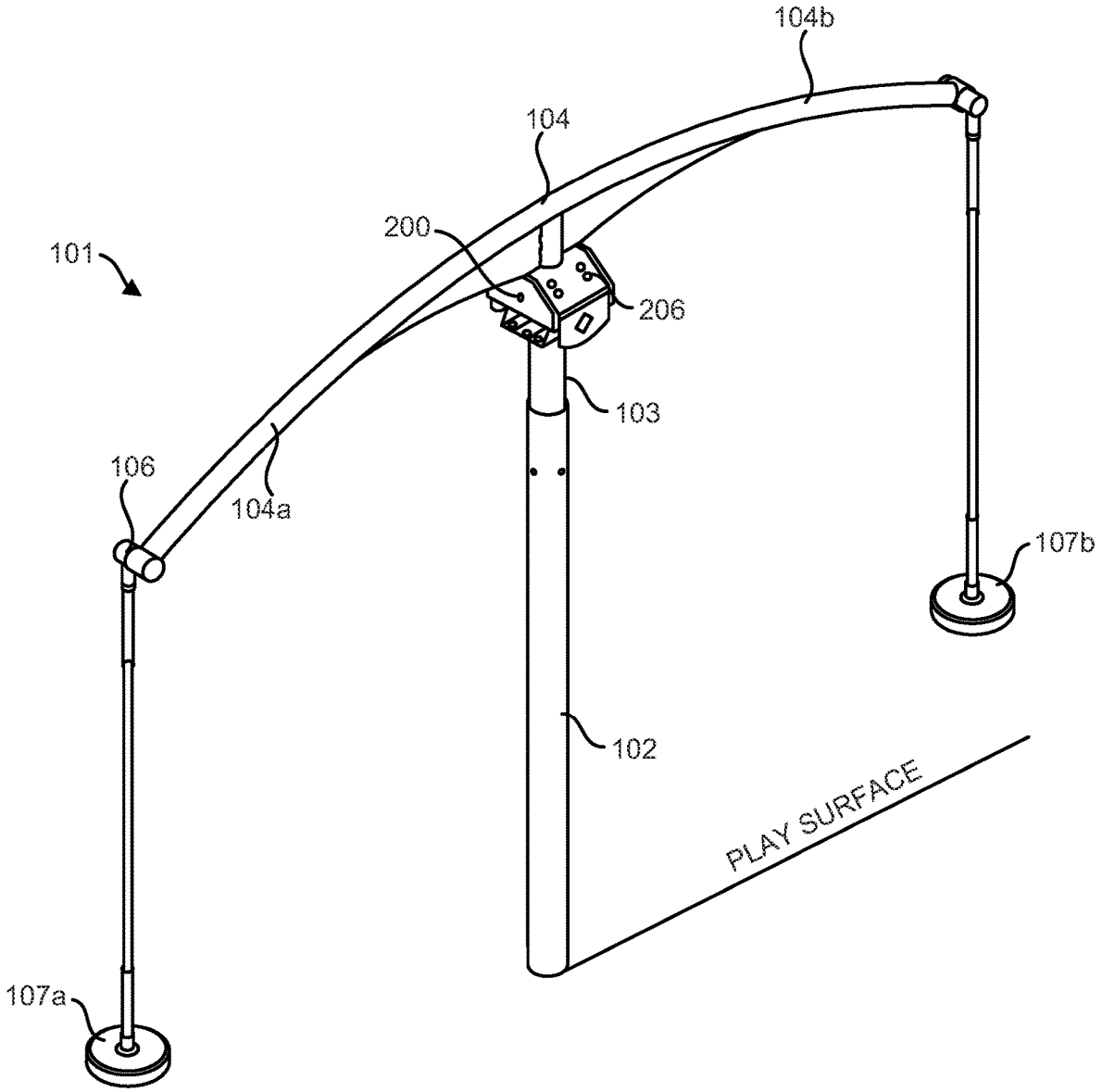
FIG. 14 is a perspective view of another embodiment of the rotatable play device.
Figure 15:
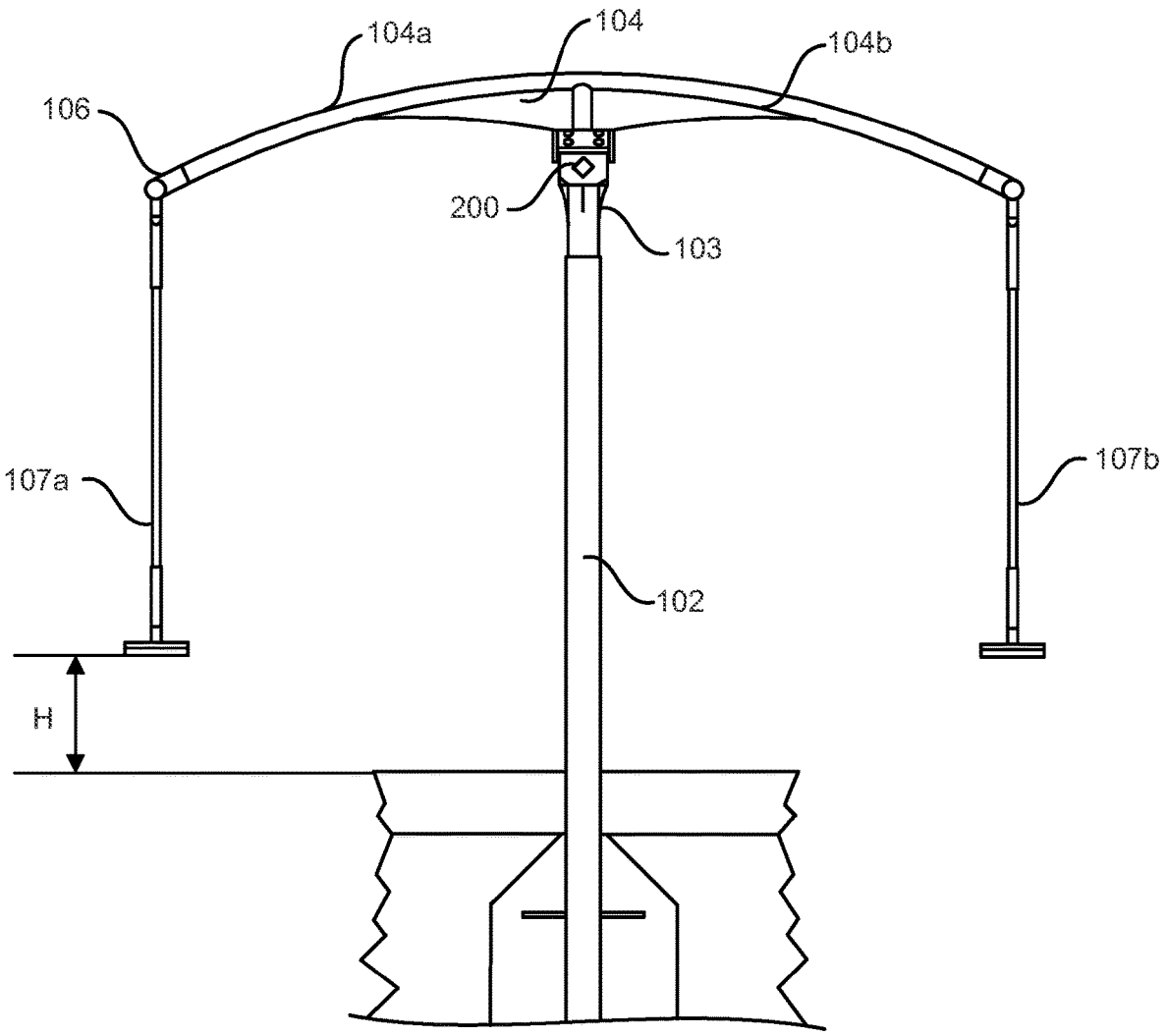
FIG. 15 is a side elevation view of the embodiment shown in FIG. 14.

In other embodiments, such as that illustrated in FIGS. 12 to 13, the arms 4 may comprise a framework 25 but may not comprise colored, translucent panels 24. In some embodiments, the colored, translucent panels 24 may be replaced with one or more inserts having a design that is configured to coincide with a themed playground. For instance, in the embodiment shown in FIGS. 12 to 13, the panels 24 have been replaced with perforated metal inserts 26. In other embodiments, the inserts could mimic the canopy of a forest or the leaves/branches of a tree. The variety of themed inserts that could be incorporated into the arms 4 of the play device 1 of the present disclosure is endless.

Another embodiment of a play device 101 in accordance with the present description is shown in FIGS. 14-22B. The play device 101 comprises a central support post 102 and a hub 103 which is rotatably mounted to an upper end of the central support post. The play device 101 also comprises an arm assembly 104 comprising a plurality of arms 104*a*, 104*b* extending away from the central support post 102. Each arm 104*a*, 104*b* is attached to the hub 103 and has a distal end 106 that is configured to support a seat 107. The play device 101 also comprises a plurality of seats 107, with each seat being suspended from the distal end 106 of one of the arms 104*a*, 104*b*. Rotation of the seats 107 around the central support post 102 may occur in the same manner described above with respect to the embodiments shown in FIGS. 1-13. Similarly, swinging of each seat 107 in one or more directions may also occur in the same manner described above with respect to the embodiments shown in FIGS. 1-13. Motion of the seats 107 in one or more directions may also be achieved by one or more motion limiters 30 as described herein with respect to the embodiments shown in FIGS. 1-13.

The play device 101 shown in FIGS. 14-22B also comprises an additional movement that is not provided by the embodiment shown in FIGS. 1-13. That additional movement may comprise a shared and reciprocal bouncing movement, such as that shown in FIGS. 22A and 22B.

In particular, as an occupant of seat 107*a* pushes up off of the ground, the distal end 106 of the arm 104*a* from which that seat is suspended may move upward. That same motion may cause the distal end 106 of an opposing arm 104*b* and that associated seat 107*b* to move downward. For instance, as an occupant of a seat 107*a* suspended from the distal end 106 of the first arm 104*a* pushed upward, the distal end of the second arm 104*b* (and thus the occupant of seat 107*b* suspended from the second arm) may be moved downward. A spring 200, which is actuated by this movement of the arm assembly 104, may then bring about a reciprocal countermovement which causes the distal end 106 of the first arm 104*a* to move downward and the distal end of the second arm 104*b* to move upward. This alternating movement may repeat a number of times (with each iteration having a lesser intensity than the previous) depending on the characteristics of the spring 200 and the amount of force used to initiate the movement. Moreover, as a seat 107*a*, 107*b* moves downward, an occupant may push up off of the play surface, creating a bouncing movement of greater intensity and restarting the cycle of alternating up and down movements. Embodiments of the rotatable play device 101 thus provides occupants of the first and second seats 107*a*, 107*b* with a shared, reciprocal up and down movement, in addition to the shared rotational movement described above.

Figure 16:
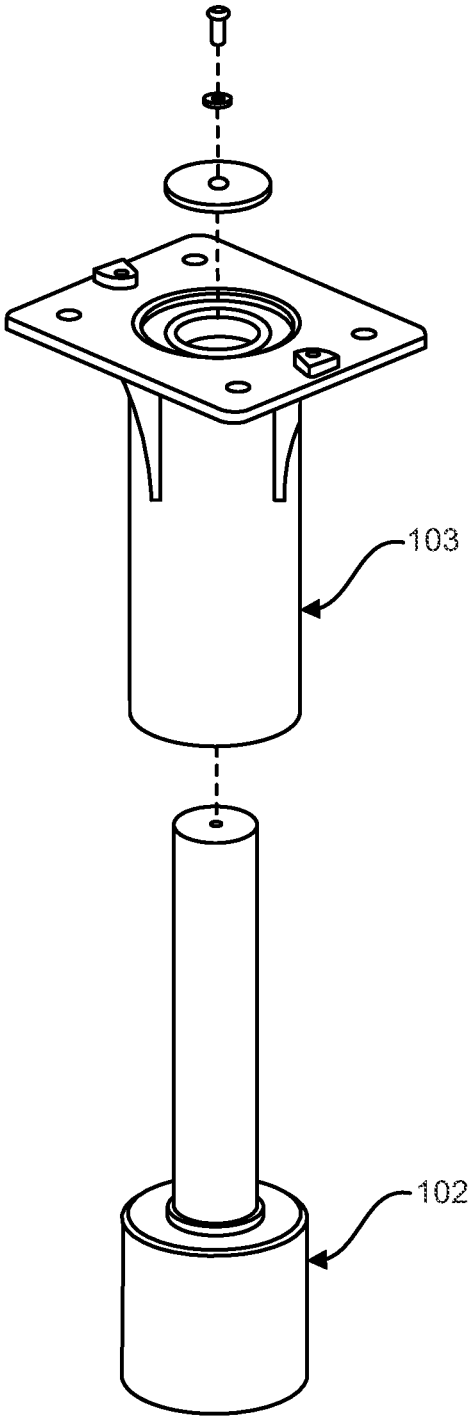
FIG. 16 is an exploded view of a central hub and an upper end of the support post in accordance with an embodiment of the rotatable play device.
Figure 17:
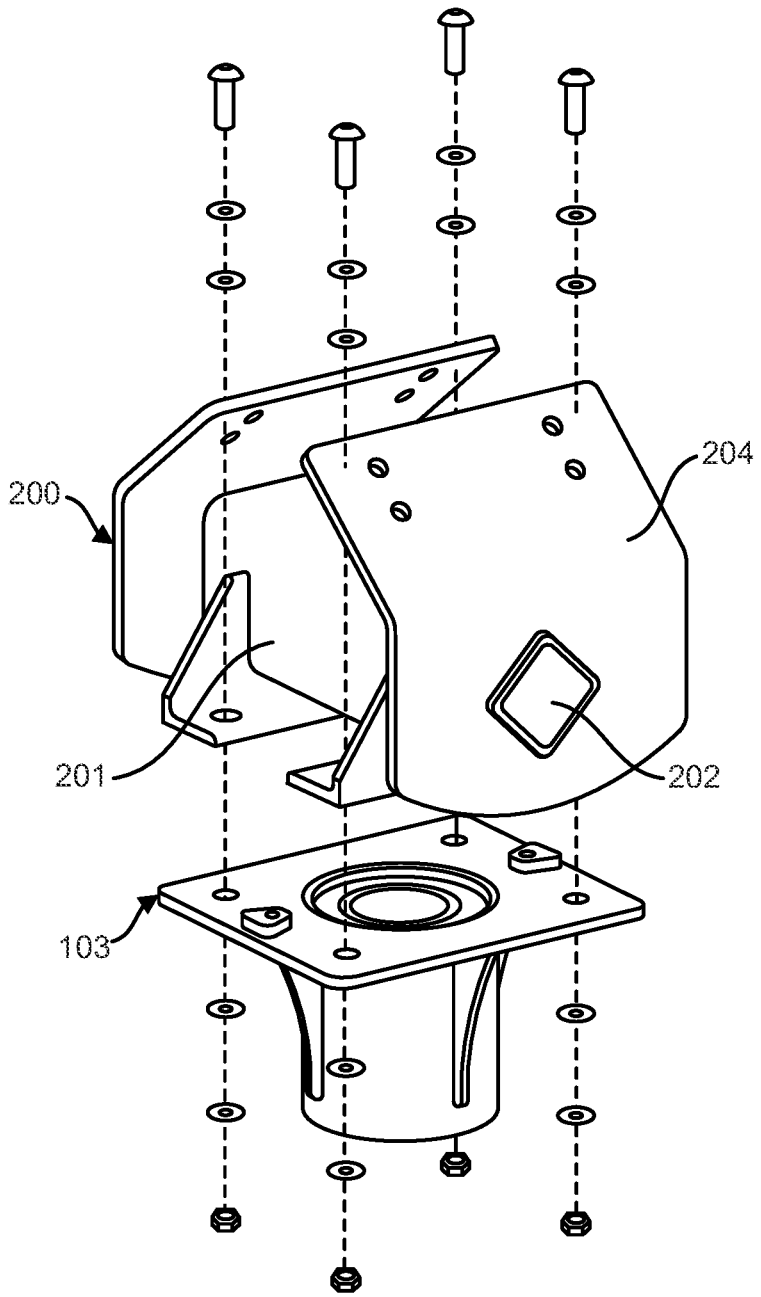
FIG. 17 is an exploded view of a spring assembly and the central hub in accordance with an embodiment of the rotatable play device.

The embodiment of the play device 101 shown in FIGS. 14-22B comprises an embodiment of a spring assembly 200 that provides for the shared and reciprocal bouncing movement. As shown in FIG. 17, the spring assembly 200 is desirably mounted, or otherwise connected (for instance, a portion of the spring assembly could be integrally formed with or welded) to the central hub 103. As shown in FIG. 16, the central hub 103 is configured to rotate on the central post 102, such as through an internal bearing assembly. Accordingly, by way of its connection to the hub 103, the spring assembly 200 may also rotate about the central post 102.

Figure 18:
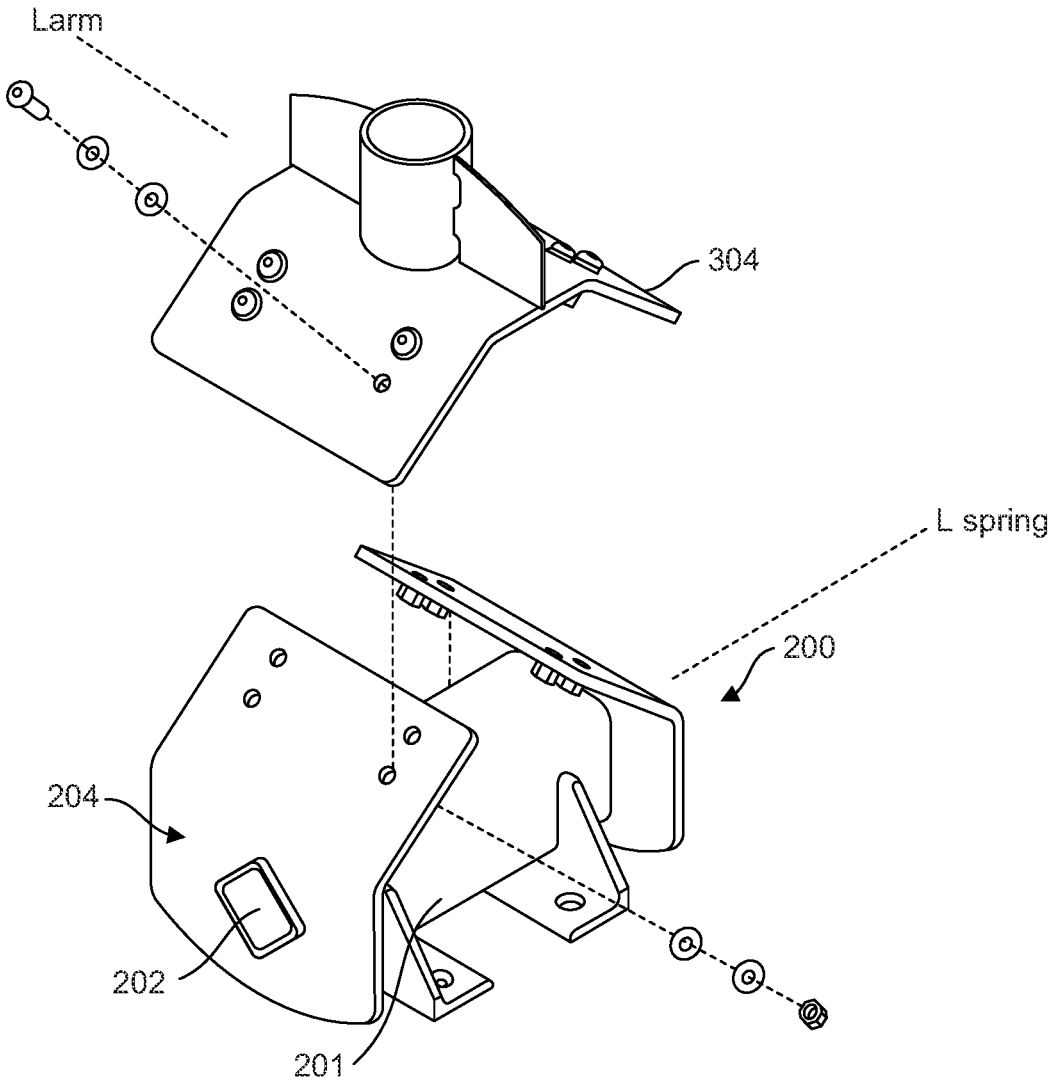
FIG. 18 is an exploded view of the spring assembly and an arm assembly connector element in accordance with an embodiment of the rotatable play device.

The spring assembly 200 may take on any number of configurations, as various types of different springs may be used without departing from the scope of the present disclosure. One embodiment of a spring assembly 200 that has been found to be particularly useful to provide the arm assembly 104 with the desired bouncing movement is illustrated in FIGS. 14-25. The illustrated embodiment of the spring assembly 200 comprises an outer body 201, an inner body 202, and one or more flexible, e.g. elastomeric, elements 203 positioned between the inner and outer bodies. The inner body 202 may also comprise end plates 204 at its first and second ends, such as is illustrated in FIGS. 17 and 18.

Figure 20:
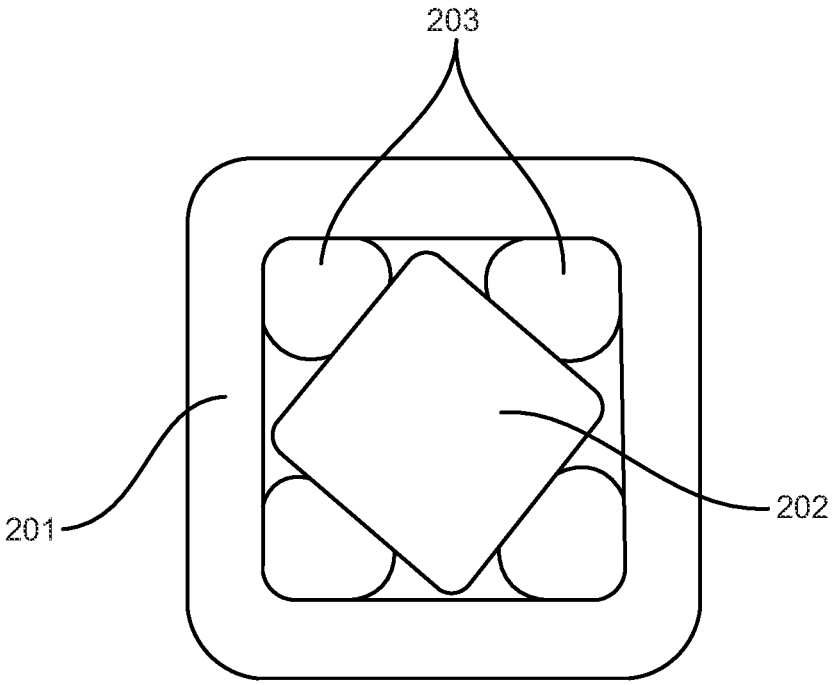
FIG. 20 is a side elevation view of a cross-section of a spring assembly in accordance with an embodiment of the rotatable play device, taken along a spring axis and showing the spring assembly in a first, i.e. rest, position.
Figure 21:
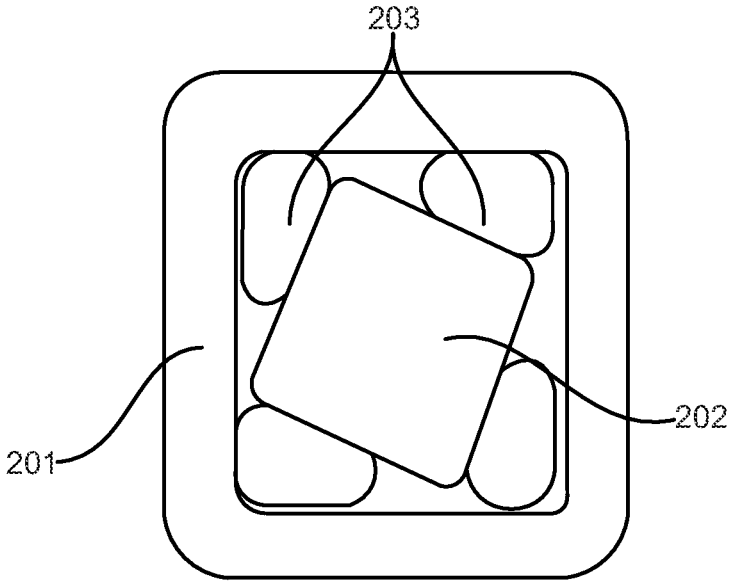
FIG. 21 is a side elevation view of a cross-section of a spring assembly in accordance with an embodiment of the rotatable play device, taken along a spring axis and showing the spring assembly in a second, i.e. actuated, position.
Figure 22A:
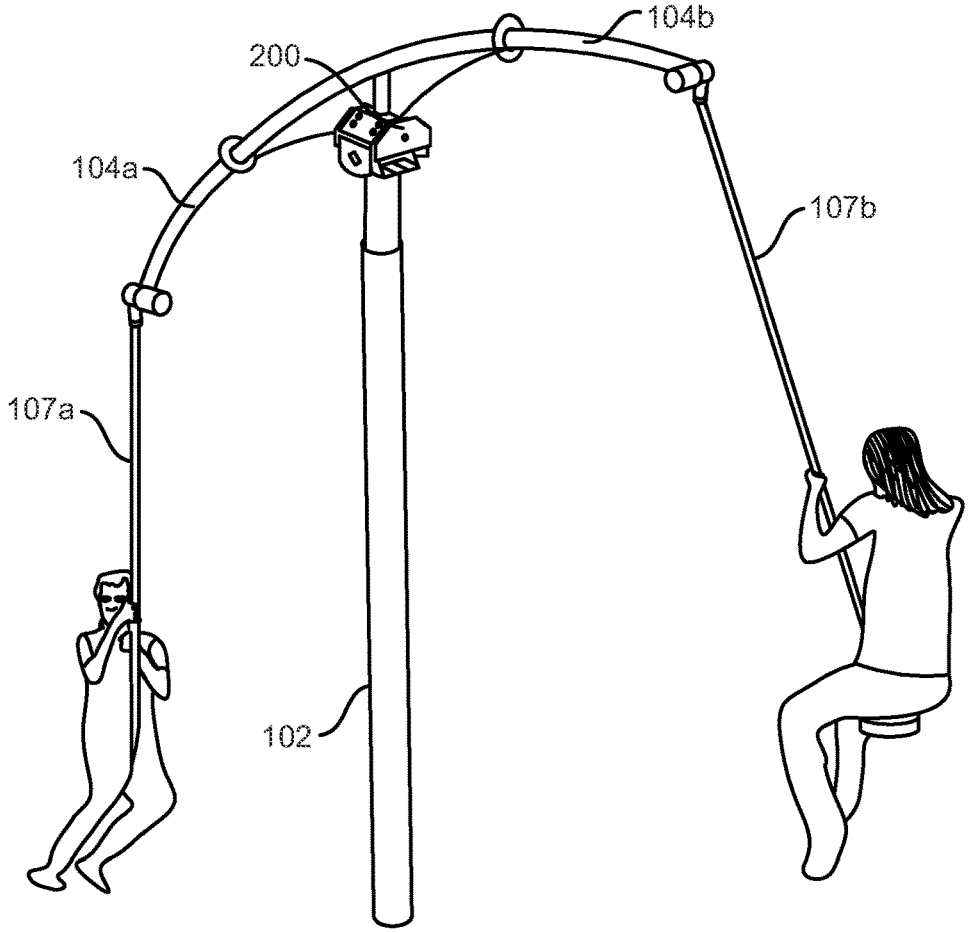
FIG. 22A is a perspective view of an embodiment of a rotatable play device, showing operation of the spring assembly to provide the occupants of first and second seats with a shared and reciprocal bouncing motion.
Figure 22B:
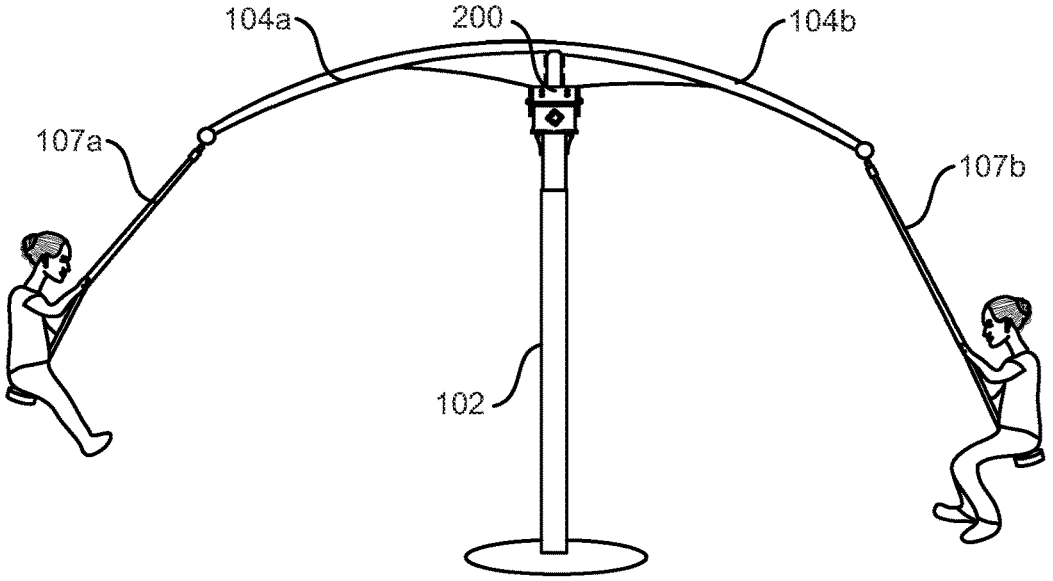
FIG. 22B is a perspective view of an embodiment of a rotatable play device, showing operation of the spring assembly to provide the occupants of first and second seats with a shared and reciprocal bouncing motion.

Operation of the illustrated spring assembly 200 may be best understood with reference to FIGS. 20 and 21, which show a cross-section of the spring assembly in two different positions. In FIG. 20, the inner body 202 is shown in a rest position, i.e. the position to which the inner body is biased by the one or more elastomeric elements 203. In FIG. 21, the inner body 202 is shown in an actuated position. When actuated, the inner body 202 rotates within the outer body 201. Rotation of the inner body 202 compresses the one or more flexible, e.g. elastomeric, elements 203, as shown in FIG. 21. In response to this compression of the one or more elastomeric elements 203, those elements may bias the inner body 202 back toward the rest position.

In a rotatable play device 101 comprising the illustrated embodiment of a spring assembly 200, movement of the arm assembly 104 causes the inner body 202 to rotate within the outer body 201. For instance, as an occupant of a first seat 107*a* (positioned to the right of the spring assembly illustrated in FIGS. 20-21) pushes upward from the play surface, the inner body 202 will rotate to a position such as that shown in FIG. 21. As the occupant of the first seat 107*a* moves back downward toward the play surface, the weight of that movement may cause the inner body 202 to rotate in the direction opposite to that shown in FIG. 21. This series of motions may be repeated any number of times, as described above, with the inner body 202 rotating back and forth (counterclockwise and clockwise) within the inner body 201 to the degree permitted by the elastomeric members 203 and depending on the amount of force provided by the seat occupants. The amount of vertical movement of the seats 107 may be controlled by the selection of one or more flexible members 203 having defined elastomeric properties, as well as by the relative sizing of those members and the inner body 201 within the outer body 202.

The arm assembly 104 may be coupled to the inner body 202 of the spring assembly 200 so as to bring about the above-described rotation in any of a variety of ways. As illustrated in FIG. 18, the inner body 202 of the spring assembly 200 may comprise end plates 204 to which an arm assembly connector 304 may be secured. In the illustrated embodiment, for example, the arm assembly connector 304 is affixed to the end plates 204 by conventional fasteners, e.g. bolts, screws, or the like. The arm assembly connector 304 may be connected to the end plates 204 in any number of other (non-illustrated) manners as well, such as by welding or by being formed integrally with the end plates.

As shown in FIG. 18, the spring assembly 200 may be defined by an axis $L_{spring}$ that runs between the first and second ends of the spring, e.g. between the first and second end plates 204. Further, the arm assembly 104 may comprise at least first and second arms 104*a*, 104*b* extending in opposing directions along a longitudinal axis $L_{arm}$. In order to provide the most efficient rotation of the inner member 202 within the outer member 201, and as shown in the embodiment illustrated in FIGS. 14-22B, the longitudinal axis of the opposing arms $L_{arm}$ may be substantially perpendicular to the spring axis $L_{spring}$.

Figure 19:
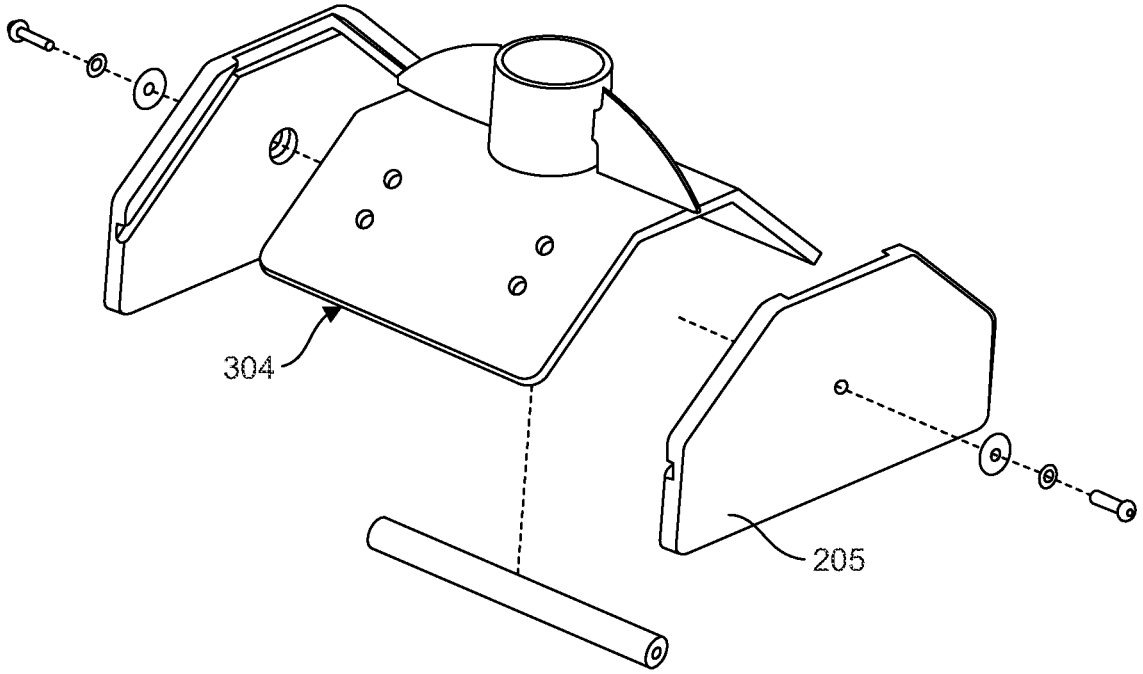
FIG. 19 is an exploded view of the arm assembly connector element and additional cover elements in accordance with an embodiment of the rotatable play device.

The spring assembly 200 may also comprise one or more cover elements 205, which may conceal one or more surfaces of the spring element and provide a housing 206 having a desired aesthetic. In the illustrated embodiment, and as shown in FIG. 19, for example, cover elements 205 are placed on the sides of the spring assembly 200 adjacent to the end plates 204. Together with end plates 204, the cover elements create a housing 206 for the spring assembly. As shown, the spring assembly may also be bordered and enclosed on its bottom by central hub 103 and on its top by arm assembly connector 304. The one or more cover elements 205 may be attached to the spring assembly 200 in any known manner.

The arm assembly 104 of the play device 101 may also differ from that shown in FIGS. 1-13. In the embodiment shown in FIGS. 14-22B, for example, the arm assembly 104 may comprise at least a first arm 104*a* and a second arm 104*b*. As illustrated, the first arm 104*a* and the second arm 104*b* extend away from the hub 103 in opposing directions, i.e., they form an angle of about 180 degrees with one another. In other embodiments, however, the first arm 104*a* and the second arm 104*b* may not extend in opposing directions, but rather may be positioned at any angle with one another, e.g. 120 degrees, 90 degrees, etc.

Moreover, in the embodiment shown in FIGS. 14-22B the first arm 104*a* and the second arm 104*b* are integral with one another. In other words, a single element spans between the distal end 106 of the first arm 104*a* and the distal end of the second arm 104*b*. That element is secured to the hub 103, and specifically to the housing 206 of the spring assembly 200 that is mounted to the hub. Specifically, the integral arm assembly 104 that comprises first and second arms 104*a*, 104*b* is attached to an arm assembly connector 304, which is mounted to the end plates 204 of the spring assembly 200. The integral arm assembly 104 comprising first and second arms 104*a*, 104*b* may be attached to the arm assembly connector 304 in any known manner, including for example by one or more fasteners, by welding, by being integrally formed therewith, or the like.

Because the first arm 104*a* and the second arm 104*b* are integral with one another, an upward movement to the distal end 106 of the first arm 104*a* will result in a corresponding downward movement to the distal end of the second arm 104*b* and vice versa. In other embodiments, the first arm 104*a* and the second arm 104*b* may simply be affixed together, such as by welding or by any number of conventional fasteners (e.g. bolts, etc.), rather than integral, so as to provide the same shared and reciprocal up and down movement. For instance, a proximal end of the first arm 104*a* may be affixed directly to a proximal end of the second arm 104*b*, or the proximal ends of the first and second arms 104*a*, 104*b* may both be affixed to a connecting element. The connecting element may also be attached to the hub 103, such as directly or by way of the spring assembly 200.

Figure 23:
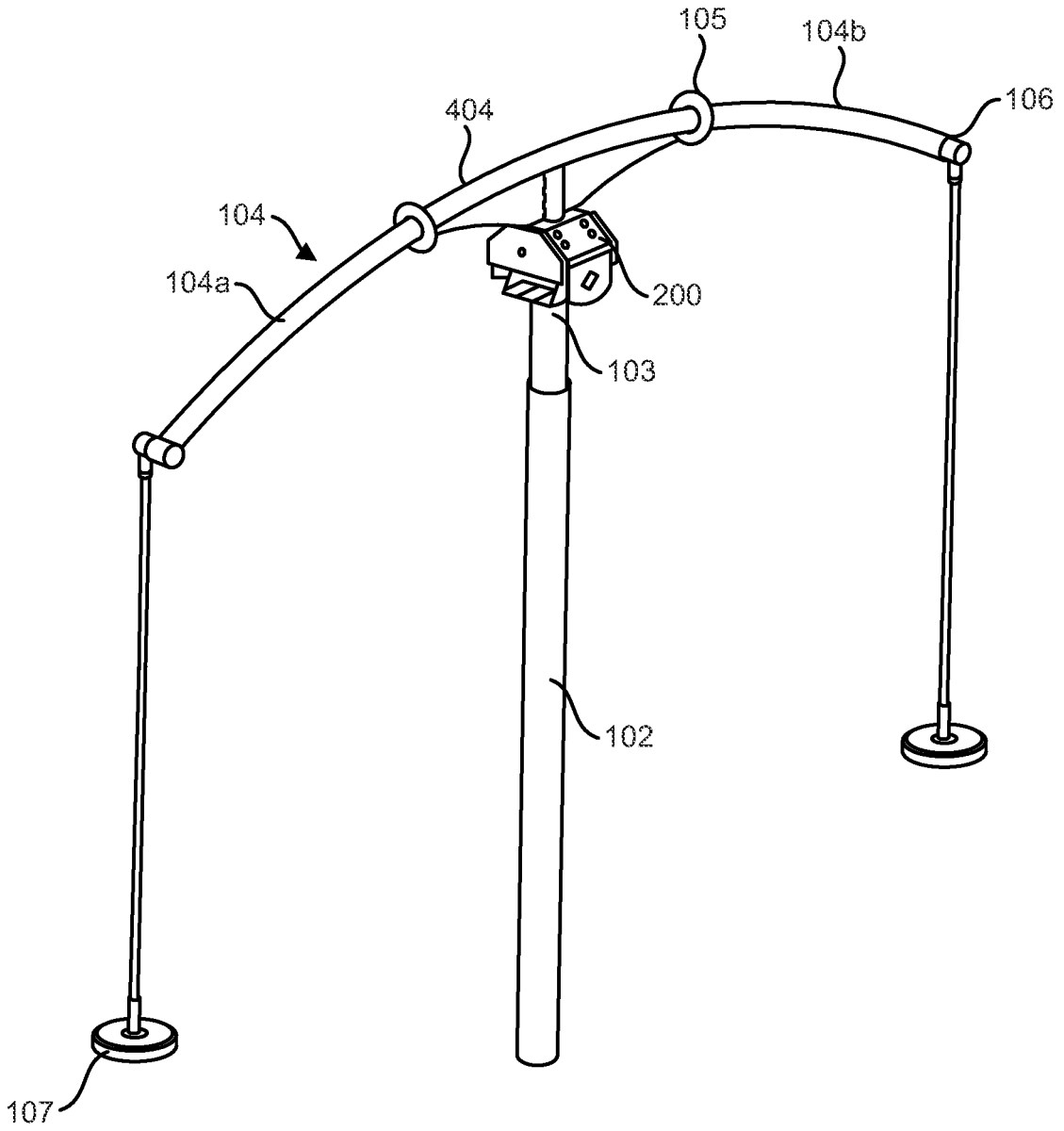
FIG. 23 is a perspective view of another embodiment of a rotatable play device.
Figure 24:
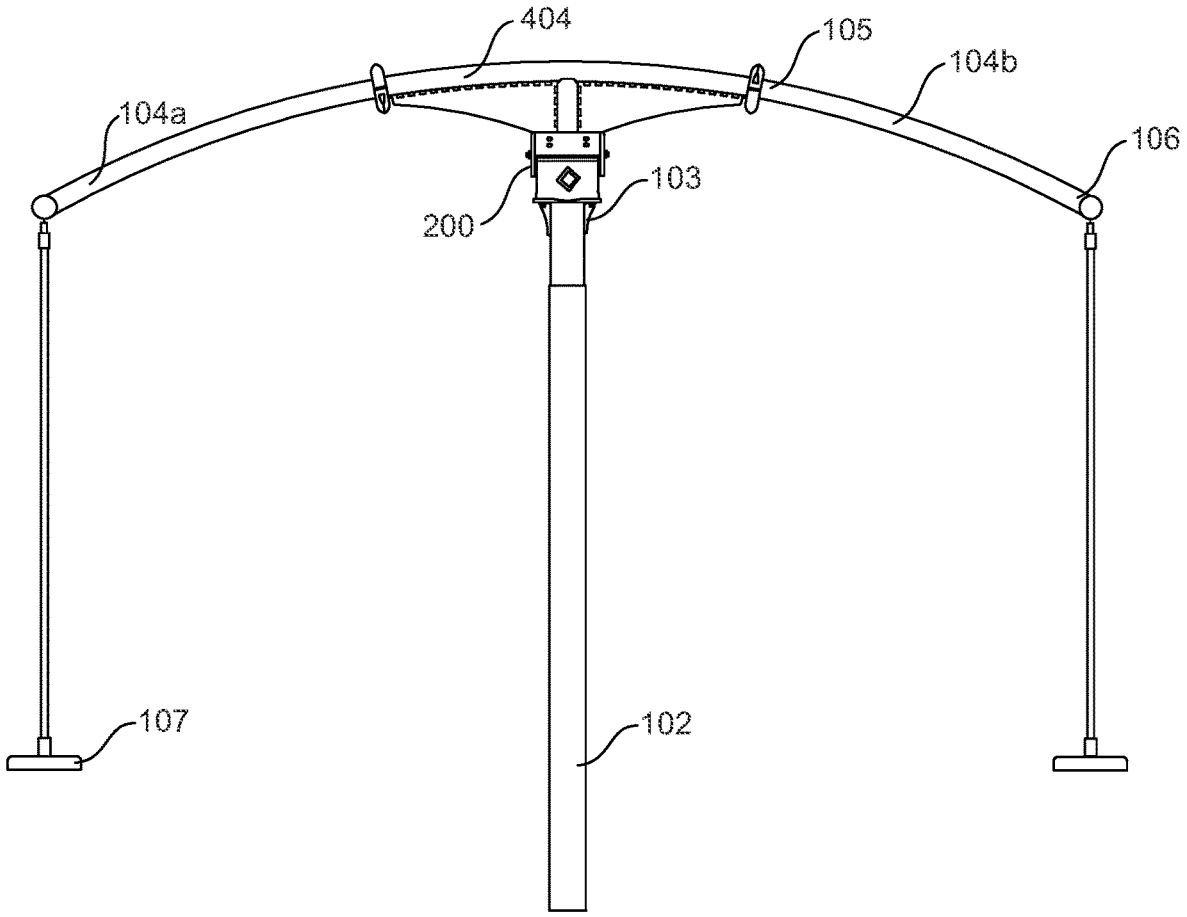
FIG. 24 is a side elevation view of the embodiment shown in FIG. 23.
Figure 25:
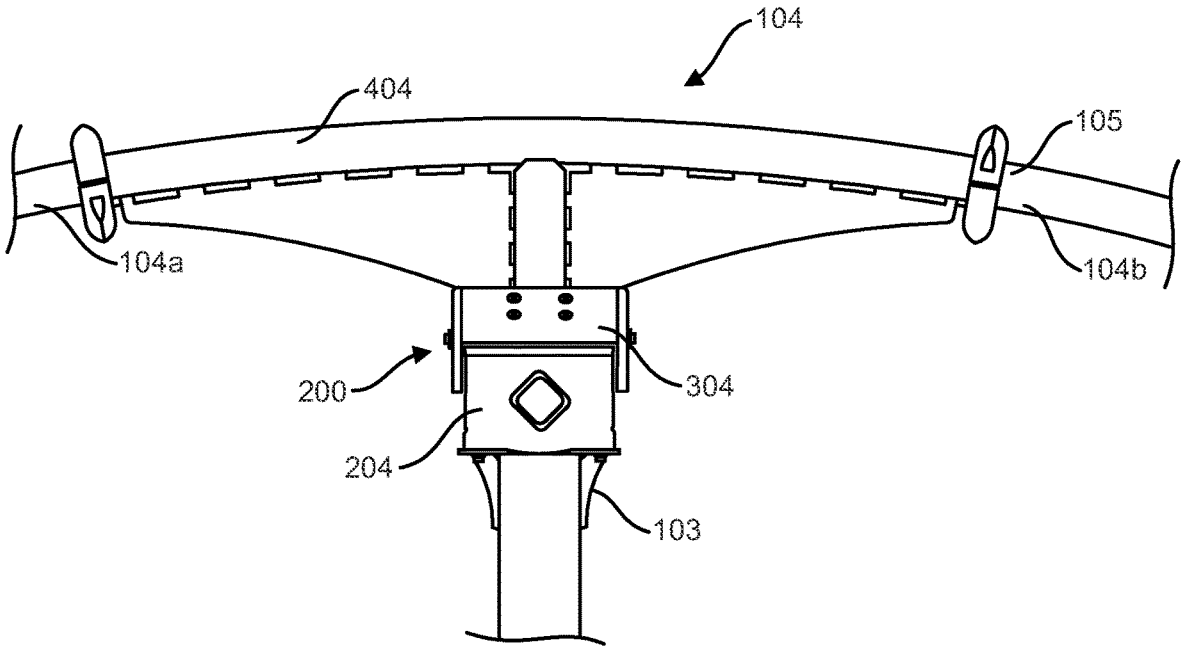
FIG. 25 is a side elevation view of a portion of the embodiment shown in FIG. 23, showing in detail the arm assembly and its connection to the rotatable hub, and more particularly to the spring assembly that is mounted on the hub.
Figure 26:
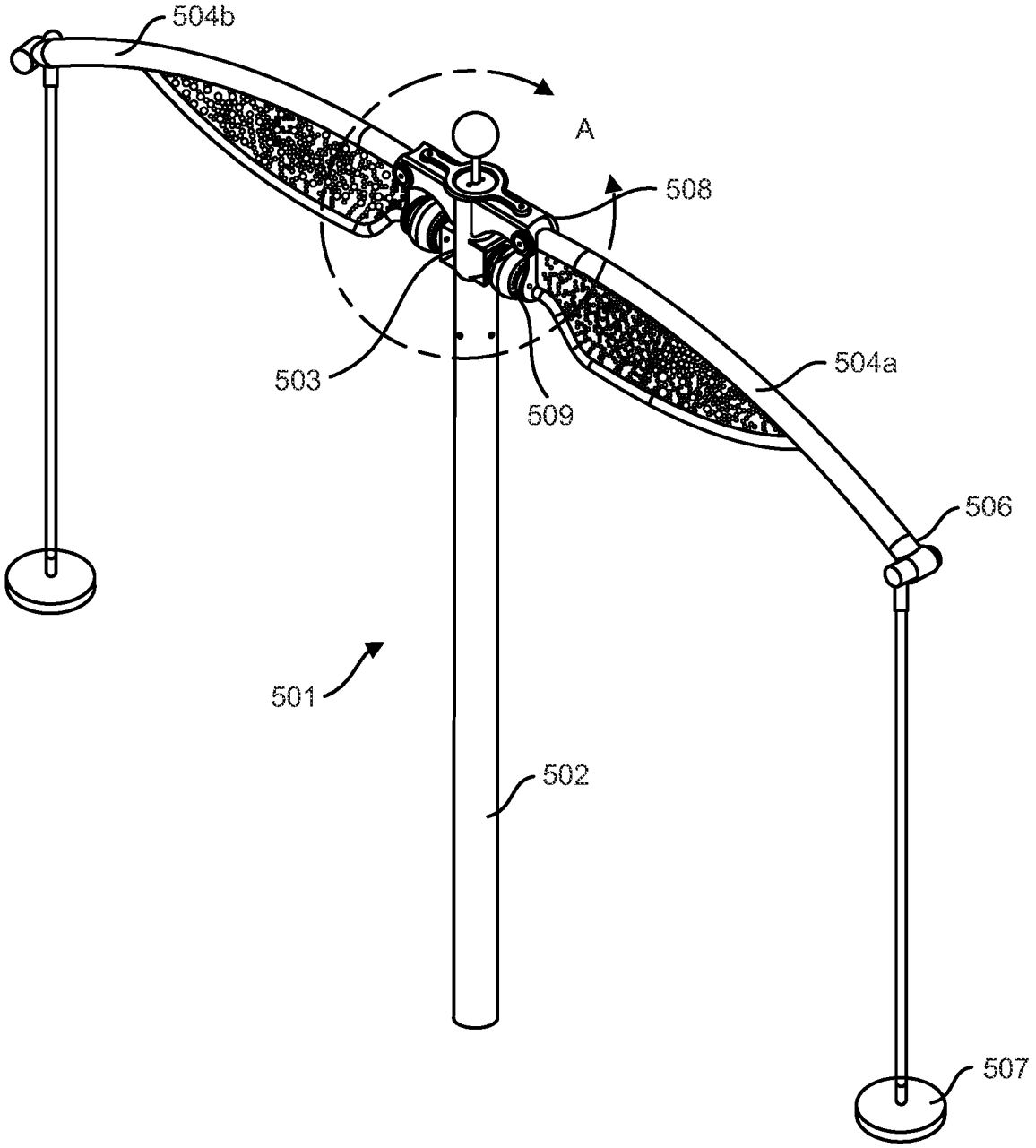
FIG. 26 is a perspective view of another embodiment of a rotatable play device.
Figure 27:
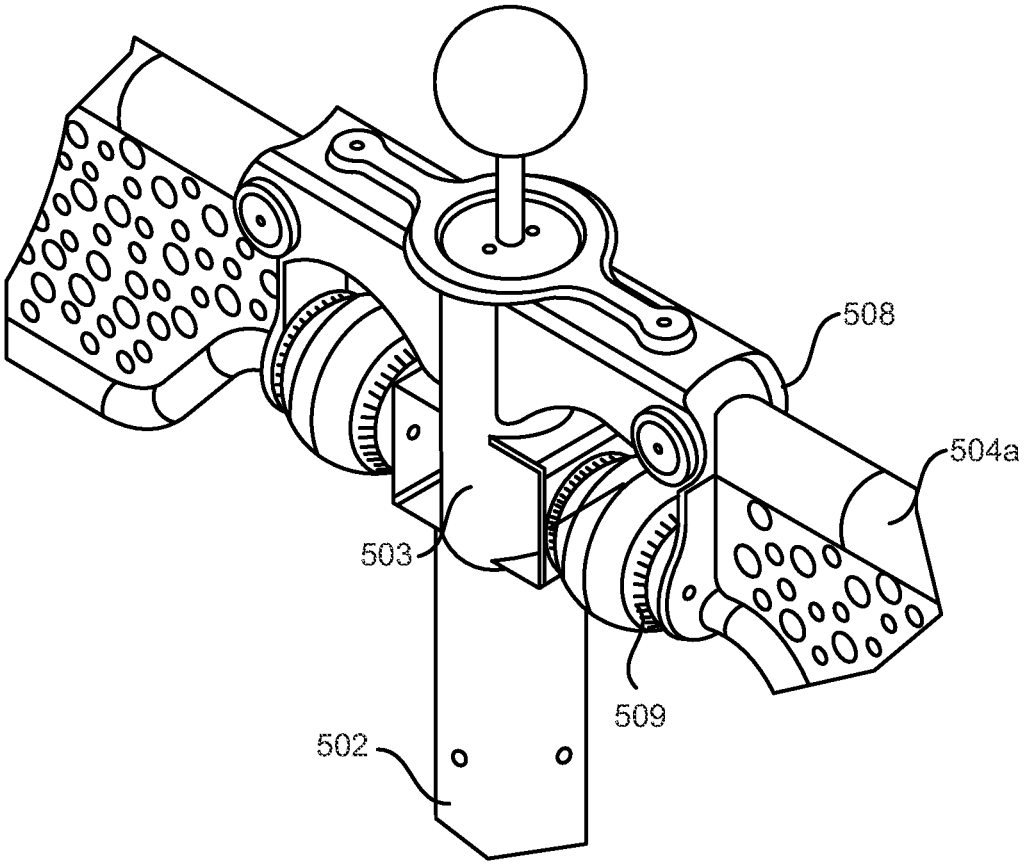
FIG. 27 is a perspective view showing in detail the hub and proximal ends of the arms in the embodiment shown in FIG. 26.

For instance, another embodiment of a rotatable play device 101 is shown in FIGS. 23-25. The embodiment illustrated in FIGS. 23-25 has a different arm assembly 104 from that of the embodiment shown in FIGS. 14-22B. In the embodiment shown in FIGS. 23-25, the first arm 104*a* and the second arm 104*b* are independent structures, each of which comprises a proximal end 105 that is affixed to a central arm element 404. Central arm element 404 is then coupled to arm assembly connector 304. Central arm element 404 may be coupled to arm assembly connector 304 through any known manner, including by one or more fasteners, by welding, or by being integrally formed therewith. Similarly, each of the first and second arms 104*a*, 104*b* may be affixed to the central arm element 404 through any known manner, including by one or more fasteners or by welding. For example, as illustrated, the proximal ends 105 of the first and second arms 104*a*, 104*b* may each comprise a flange that is sized and configured to abut or mate with a flange of the central arm element 404. One or more fasteners, e.g. bolts, may then be passed through aligned apertures on the flanges to thereby secure the first or second arm element 104*a*, 104*b* to the central arm element 404. If desired, the assembly 104 may then be covered with a rubber shroud.

In other, non-illustrated embodiments, the arm assembly 104 may comprise a number of arms other than two. For instance, in some embodiments, the arm assembly 104 may comprise a first pair of arms extending in opposing directions, such as is described above, and a second pair of arms of extending in opposing directions. For instance, the second pair of arms may be positioned such that they form a 90 degree angle with the first pair of arms (i.e. such that both pairs of arms form the shape of a "+" when viewed from above). Alternatively, the first and second pairs of arms may be positioned at different angles, though it is necessary to ensure that sufficient space exists between adjacent seats 107. The second pair of arms may be configured to operate in the same manner as the first pair of arms. For instance, the hub may comprise a first spring assembly 200 associated with and operable to provide the first pair of arms with a bouncing motion and a second spring assembly associated with and operable to provide the second pair of arms with a bouncing motion.

In some embodiments, the first and second spring assemblies 200 may be substantially the same, such that the second pair of arms moves up and down in substantially the same manner and to the same degree as the first pair of arms. In other embodiments, the first and second spring assemblies 200 may differ from one another, such that the up and down movement of the second pair of arms differs from that of the first pair of arms. For instance, the second spring assembly 200 may have a greater tension than the first spring assembly, thereby rendering the second set of arms more difficult to bounce than the first set of arms and/or more limited in the range of the up and down motion that may be obtained. Alternatively, the second spring assembly 200 may have a lesser tension than the first spring assembly, thereby rendering the second set of arms easier to bounce than the first set of arms and/or having a wider range of distance up and down that may be travelled. In this manner, embodiments of the rotating play device 101 may provide varying bounce experiences that may be particularly suitable to children of different ages and abilities.

Although the embodiment illustrated in FIGS. 14-22B is described as comprising opposing arms 104*a*, 104*b* that have a shared and reciprocal bouncing motion, other (non-illustrated) embodiments of the play device 101 may comprise one or more arms 104 that are configured to have independent bouncing motions. For instance, each arm 104 may be associated with an independent spring 200 which provides each seat 107 with an up and down bouncing motion which operates independently from the other seats. This allows an occupant of a seat 107 to have sole control over the bouncing motion of that seat. In other embodiments, multiple arms may together act on one or more springs 200 to provide more complex interactions between the bouncing motions of the plurality of seats 107.

Moreover, although the embodiments illustrated in FIGS. 14-25 make use of a particular spring assembly 200, additional (non-illustrated) embodiments of the rotatable play device 100 described herein may comprise spring assemblies 200 having different structures and configurations, so long as the spring assemblies provide the arms 104, and hence the seats 107, with a bouncing motion. For instance, the spring assembly 200 may comprise one or more compression springs, one or more extension springs, one or more torsion springs, one or more constant force springs, one or more Belleville springs, one or more spring clips, or any combination thereof without departing from the intended scope of the present disclosure.

Another embodiment of a play device 501 in accordance with the present description is shown in FIGS. 26-29. The play device 501 comprises a central support post 502 and a hub 503 which is rotatably mounted to an upper end of the central support post. The play device 501 also comprises a plurality of arms 504*a*, 504*b* extending away from the central support post 502. Each arm 504*a*, 504*b* is attached to the hub 503 and has a distal end 506 that is configured to support a seat 507. The play device 501 also comprises a plurality of seats 507, with each seat being suspended from the distal end 506 of one of the arms 504*a*, 504*b*. Rotation of the seats 507 around the central support post 502 may occur in the same manner described above with respect to the embodiments shown in FIGS. 1-13. Similarly, swinging of each seat 507 in one or more directions may also occur in the same manner described above with respect to the embodiments shown in FIGS. 1-13. Motion of the seats 507 in one or more directions may also be achieved by one or more motion limiters 30 as described herein with respect to the embodiments shown in FIGS. 1-13.

The play device 501 shown in FIGS. 26-29 also comprises an additional movement that is not provided by the embodiment shown in FIGS. 1-13 or the embodiment shown in FIGS. 14-25. That additional movement may comprise an independent bouncing movement. In contrast to the embodiment shown in FIGS. 14-25, which provides for a shared, alternating bouncing movement, the embodiment shown in FIGS. 26-29 is configured so that the occupant of each seat 507 may independently control his or her bouncing movement.

In this embodiment, for instance, each arm 504*a*, 504*b* may be connected to the hub 503 by both a pivot 508 and a spring element 509.

As an occupant of a seat 507 placed his or her weight downward, the arm 504*a* may rotate downward about the pivot 508 such that the distal end of the arm 506 from which that seat is suspended may move downward. The downward rotation of the arm 504*a* may actuate, i.e. compress, the spring 509 associated with that arm. Actuation of the spring 509 may create a reciprocal force, i.e. expansion of the spring back toward its biased rest position, which causes the arm 504*a* to rotate back upward about the pivot 508, causing the distal end of the arm 506 and the suspended seat 507 to move upward. This alternating movement may repeat a number of times (with each of lessening intensity than the previous) depending on the characteristics of the spring 509 and the amount of force with which the movement was initiated. Moreover, as a seat 507 moves downward, an occupant may push up off of the play surface, creating a bouncing movement of greater intensity and restarting the cycle of alternating up and down movements. Notably, however, movement of any one arm, e.g. 504*a*, in this manner may have no effect on the independent movement of any other arm, e.g. 504*b*, in this manner.

Figure 28:
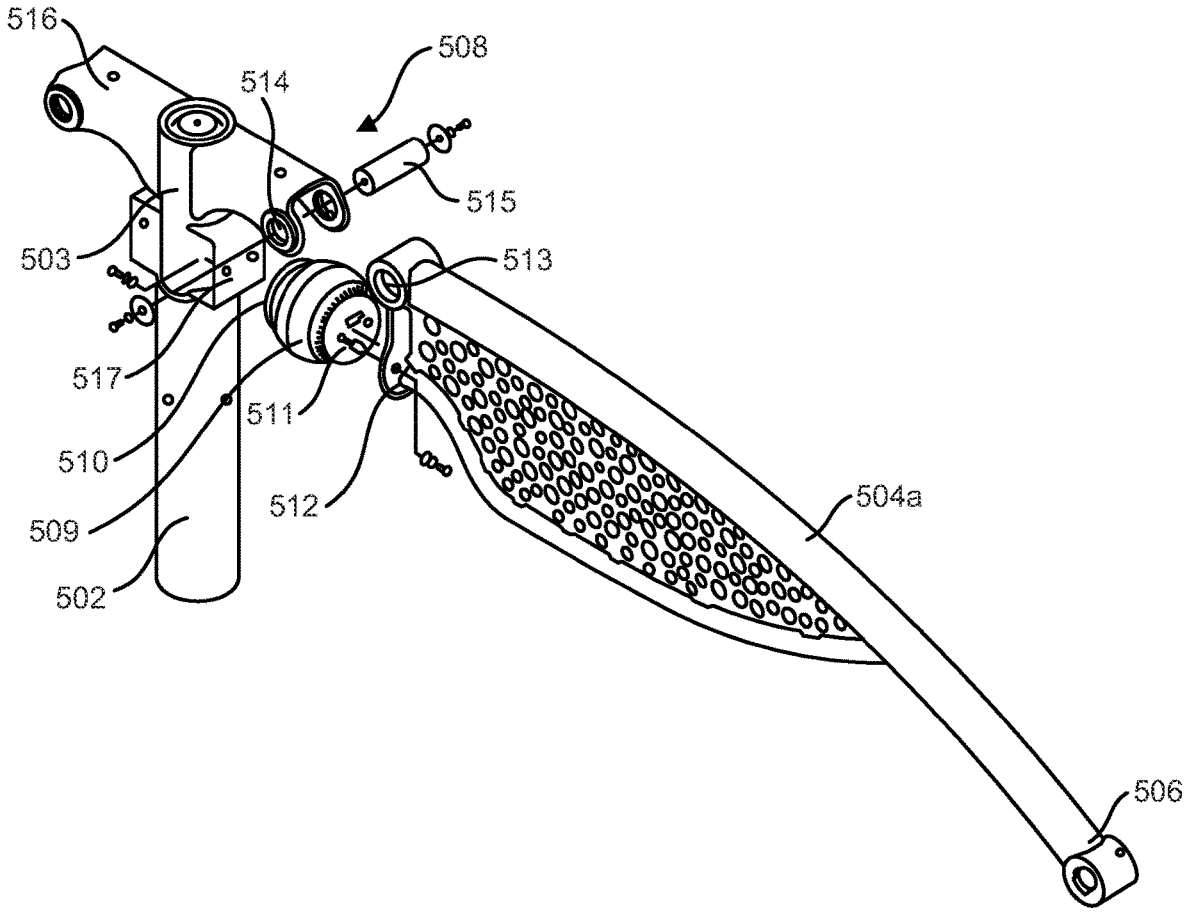
FIG. 28 is an exploded perspective view of a connection between the hub and the proximal end of an arm in the embodiment shown in FIG. 26.
Figure 29:
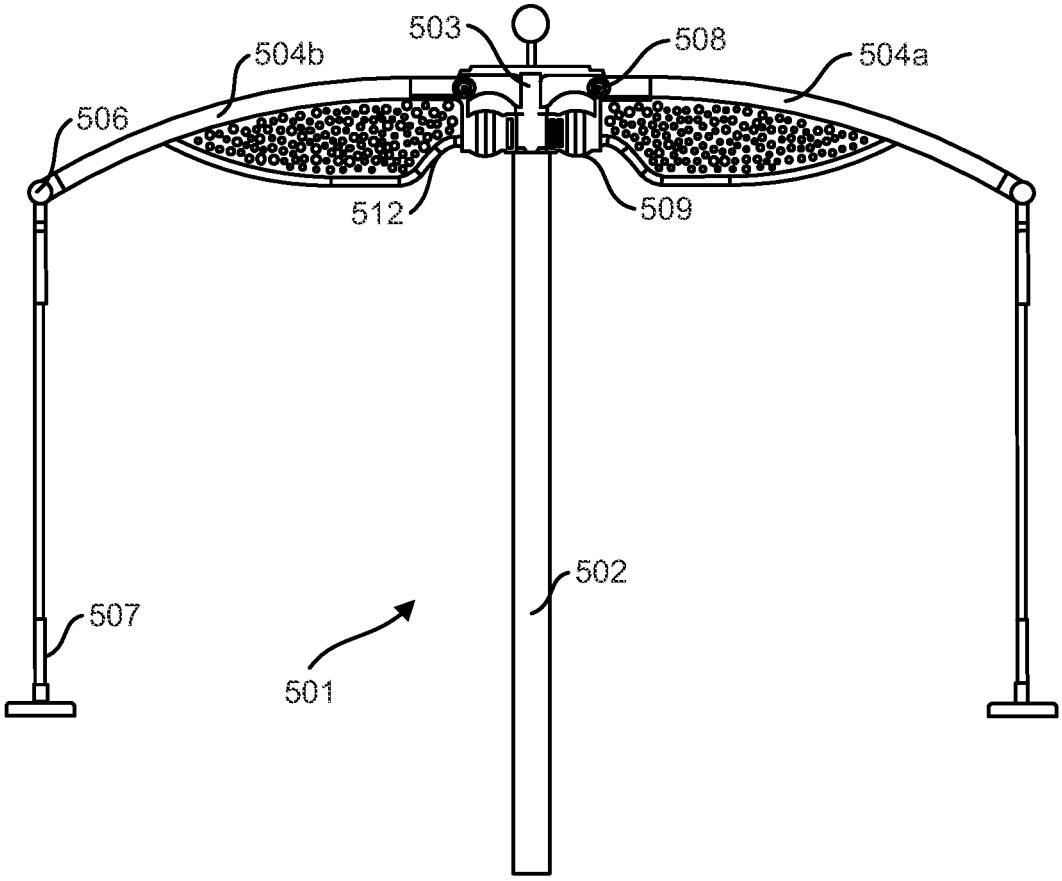
FIG. 29 is a side elevation view of the embodiment shown in FIG. 26.

The spring element 509 may take on any number of configurations, as various types of different springs may be used without departing from the scope of the present disclosure. In some embodiments, including that illustrated in FIGS. 26-29, the spring element 509 may comprise an air spring, such as an industrial air spring that is filled to a pre-determined pressure (psi). As illustrated in FIG. 28, the air spring 509 may have a first end 510 that is affixed to the hub 503 and a second end 511 that is affixed to a proximal end of the arm 512. As a downward force is applied to the distal end of the arm 506 by an occupant of the associated seat 507, the air spring 509 is compressed from the illustrated rest position to a compressed position.

The amount of force needed to compress the spring 509 a given amount, i.e. the amount of force needed to achieve a defined degree of vertical movement of the seat 507, will depend on the pressure of the air spring. Accordingly, by varying the pressure of the air spring 509, an installer may control the relative ease or difficulty of obtaining a vertical movement of the seat 507. In some embodiments, each of the plurality of springs 509 may be set to the same or substantially the same pressure, such that each of the plurality of seats 507 requires the same amount of force to achieve the same vertical movement. In other embodiments, a first spring 509 may be set to a different pressure from a second spring, such that a first seat 507 requires a different amount of force (i.e. lesser or greater) to achieve the same vertical movement as a second seat.

The range of vertical movement of a seat 507 is controlled by the amount that the spring 509 compresses between its fully-extended position and its fully-compressed position. For instance, the amount of upward vertical movement of a seat 507 depends on the positioning of the arm 504*a*, and in particular the distal end of the arm 506, when the spring 509 is in a fully-extended position. In some embodiments, including the illustrated embodiment, the fully-extended position of the air spring 509 may place the arm 504*a* at a position in which the arm is substantially horizontal with the ground or play surface.

In other embodiments, however, the fully-extended position of the air spring 509 may place the arm 540*a* at a position in which it is angled upward above horizontal at a predetermined angle. In some embodiments, for example, an arm 504*a* may be configured to pivot upward to at least 5° above horizontal, alternatively at least 10° above horizontal, alternatively at least 15° above horizontal, alternatively at least 20° above horizontal. In some embodiments, the arm 504*a* may be configured to pivot upward to 15° past horizontal, to 20° past horizontal, to 25° past horizontal, to 30° past horizontal, or the like. In these embodiments, a seat 507 may be configured such that a user may pull the seat down in order to climb on to it. Upon accessing the seat, the user's weight may naturally compress the spring 509 such that the arm 504*a* becomes positioned at a substantially horizontal orientation (e.g. within 5° of horizontal). This may be achieved, for instance, by calibrating the arm 504*a* and spring 509 assembly based on an average weight of an intended user age group.

The amount of downward vertical movement of a seat 507 depends on the positioning of the arm 504*a*, and in particular the distal end of the arm 506, when the spring 509 is in a fully-compressed position. Generally, this will be configured to allow an occupant of a seat 507 to touch and push off of the ground or play surface with his or her feet, but at the same time to prevent uncomfortable downward movements (e.g. in which the seat 507 itself would hit the ground or play surface).

In other, non-illustrated embodiments, the play device 501 may utilize a different type of spring 509 in place of an air spring 509. For instance, the spring 509 may comprise one or more compression springs, one or more extension springs, one or more torsion springs, one or more constant force springs, one or more Belleville springs, one or more spring clips, or any combination thereof without departing from the intended scope of the present disclosure.

In addition to the proximal end of the arm 512 being connected to the hub 503 through the spring 509, the proximal end of the arm is also connected to the hub through a pivot or hinge 508. The pivot 508 allows for the pivoting of the arm 504*a* to bring about the vertical movement of the seat 507. The pivot 508 may take on any number of configurations, as would be understood by those of skill in the art. In the illustrated embodiment, apertures 513 in the proximal end 512 of the arm 504*a* are aligned with apertures 514 in the hub 503 and a pivot pin 515 is inserted through the aligned apertures 513, 514 and secured to the hub.

As illustrated, the hub 503 may comprise one or more elements that facilitate the attachment of each arm 504 through both a pivot 508 and a spring 509. As in the illustrated embodiment, for instance, hub 503 may comprise a plurality of upper extensions 516 and a plurality of lower extensions 517. The pivots 508 may be associated with the ends of the upper extensions 516, e.g. as illustrated in FIG. 28. The lower extensions 517 may each be configured for attachment to a spring 509. For instance, as illustrated in FIG. 28, the lower extension 517 may include a distal surface, the back of which is accessible to an installer to facilitate securement of the spring 509 to the lower extension 517 by one or more fasteners.

In the illustrated embodiments, the play device 501 comprises two arms 504*a*, 504*b*. In other, non-illustrated embodiments, however, the play device 501 may comprise three arms, four arms, five arms, six arms, etc.

It can be seen that the described embodiments provide a unique and novel rotatable play device that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A swing assembly configured to provide a swing seat with a range of motion, the swing assembly comprising:

a hub;

a plurality of arms extending away from the hub, each arm having a distal end supporting a seat;

a plurality of seats, each seat being suspended from the distal end of one of the plurality of arms;

one or more springs configured to provide each of the plurality of arms with an up-and-down movement;

wherein the swing assembly is configured so that an occupant of a seat may (iii) swing b) in a direction parallel with a longitudinal axis of the arm from which the seat is suspended, d) in a direction perpendicular to the longitudinal axis of the arm from which the seat is suspended, or e) both a) and b); and (iv) actuate at least one of the one or more springs, such that the distal end of the arm from which the seat is suspended moves up and down; and wherein the swing assembly further comprises one or more motion limiters, each motion limiter being configured to limit the swinging motion of one of the plurality of seats, and wherein the seat is connected to the distal end of the arm by the motion limiter.

2. The swing assembly of claim 1, wherein the plurality of arms comprises a first arm and a second arm extending in opposing directions and wherein actuation of at least one of the one or more springs causes the distal ends of the first and second arms to move up and down in an alternating manner.

3. The swing assembly of claim 2, wherein the spring comprises an outer body, an inner body, and one or more elastomeric elements positioned between the inner body and the outer body;

wherein the inner body is rotatable within the outer body;

wherein rotation of the inner body compresses the one or more elastomeric elements; and wherein movement of the first and second arms causes the inner body to rotate within the outer body.

4. The swing assembly of claim 3, the inner body further comprising first and second end plates to which the first and second arms are operably connected;

wherein the first and second arms extend in opposing directions along a longitudinal axis that is substantially perpendicular to a spring axis running between the first and second end plates.

5. The swing assembly of claim 2, wherein the swing assembly is configured so that an occupant of a seat may swing in a direction parallel with a longitudinal axis of the arm from which the seat is suspended.

6. The swing assembly of claim 1, wherein the swing assembly is configured so that an occupant of a seat may swing in a direction parallel with a longitudinal axis of the arm from which the seat is suspended.

7. The swing assembly of claim 1, wherein the swing assembly is configured so that an occupant of a seat may swing in a direction perpendicular to the longitudinal axis of the arm from which the seat is suspended.

8. The swing assembly of claim 1, wherein the hub is mounted to a support post.

9. The swing assembly of claim 8, wherein the support post is non-removably mounted to a play surface in an outdoor playground environment.

10. The swing assembly of claim 8, wherein the hub is configured to rotate about the support post.

11. The swing assembly of claim 1, wherein at least one of the plurality of seats is suspended from the distal end of the arm by a flexible cable.

12. The swing assembly of claim 11, wherein the at least one of the plurality of seats is a disc seat.

13. The swing assembly of claim 1, wherein at least one of the plurality of seats is a disc seat, a belt seat, a board seat, a bucket seat, a chair seat, or an inclusive play seat.

14. The swing assembly of claim 1, wherein the up-and-down movement of each arm is independent from the up-and-down movement of each of the other arms.

15. The swing assembly of claim 1, wherein at least one of the one or more springs is an air spring.

16. The swing assembly of claim 1, wherein a rest position of the one or more springs corresponds with the plurality of arms being substantially parallel with the play surface.

* * * * *